US009768556B2

(12) United States Patent
Bopp et al.

(10) Patent No.: US 9,768,556 B2
(45) Date of Patent: Sep. 19, 2017

(54) CONNECTOR WITH CAPACITIVE CROSSTALK COMPENSATION TO REDUCE ALIEN CROSSTALK

(71) Applicants: Tyco Electronics Corporation, Berwyn, PA (US); Tyco Electronics UK Ltd., Swindon, Wiltshire (GB)

(72) Inventors: Steven Richard Bopp, Jamestown, NC (US); Bernard Harold Hammond, Jr., Cheltenham (GB)

(73) Assignees: COMMSCOPE TECHNOLOGIES LLC, Hickory, NC (US); COMMSCOPE CONNECTIVITY UK LIMITED (GB)

( * ) Notice: Subject to any disclaimer, the term of this patent is extended or adjusted under 35 U.S.C. 154(b) by 159 days.

(21) Appl. No.: 14/211,260

(22) Filed: Mar. 14, 2014

(65) Prior Publication Data

US 2014/0273634 A1 Sep. 18, 2014

Related U.S. Application Data

(60) Provisional application No. 61/792,208, filed on Mar. 15, 2013, provisional application No. 61/793,304, filed on Mar. 15, 2013.

(51) Int. Cl.
*H01R 13/6466* (2011.01)
*H01R 13/6464* (2011.01)
(Continued)

(52) U.S. Cl.
CPC ..... *H01R 13/6466* (2013.01); *H01R 24/64* (2013.01); *H01R 4/2433* (2013.01)

(58) Field of Classification Search
CPC ..... H01R 13/6466; H01R 13/6464; H01R 13/6461; H01R 13/6467; H01R 13/6469
See application file for complete search history.

(56) References Cited

U.S. PATENT DOCUMENTS 5,299,956 A 4/1994 Brownell et al.
5,997,358 A 12/1999 Adriaenssens et al.
(Continued)

FOREIGN PATENT DOCUMENTS

JP 2004-31130 1/2004
WO 2010/019785 A1 2/2010

OTHER PUBLICATIONS

International Search Report and Written Opinion for PCT/US2014/029268 mailed Jul. 28, 2014.
(Continued)

*Primary Examiner* — James Harvey
*Assistant Examiner* — Matthew T Dzierzynski
(74) *Attorney, Agent, or Firm* — Merchant & Gould P.C.

(57) ABSTRACT

The present disclosure relates to a telecommunications connector having cross-talk compensations, and a method of managing alien crosstalk in such a connector. In one example, the telecommunications connector includes electrical conductors arranged in differential pairs and a circuit board with conductive layers that provide a cross-talk compensation arrangement for applying capacitance between the electrical conductors. The circuit board includes conductive paths that provide capacitive coupling and a conductive plate that intensifies capacitive coupling of the electrical conductors. In another example, the telecommunications connector is used with a twisted pair system. Capacitances applied by the crosstalk compensation arrangement between electrical conductors associated with the pairs are provided such that, for each differential pair, a magnitude of an overall capacitance at a first electrical conductor of a differential pair is approximately equal to a magnitude of an overall capacitance at a second electrical conductor of the differential pair.

31 Claims, 17 Drawing Sheets

(51) Int. Cl.

| | |
|---|---|
| ***H01R 13/6461*** | (2011.01) |
| ***H01R 13/6467*** | (2011.01) |
| ***H01R 13/6469*** | (2011.01) |
| ***H01R 24/64*** | (2011.01) |
| *H01R 4/24* | (2006.01) |

(56) References Cited

U.S. PATENT DOCUMENTS

| | | | | |
|---|---|---|---|---|
| 6,096,980 | A | 8/2000 | Ferry | |
| 6,488,544 | B1 * | 12/2002 | Hyland | 439/676 |
| 7,402,085 | B2 * | 7/2008 | Hammond et al. | 439/676 |
| 7,658,651 | B2 * | 2/2010 | Pepe et al. | 439/676 |
| 7,798,857 | B2 | 9/2010 | Hammond, Jr. et al. | |
| 8,016,621 | B2 | 9/2011 | Bopp et al. | |
| 8,282,425 | B2 | 10/2012 | Bopp et al. | |
| 2005/0136729 | A1 | 6/2005 | Redfield et al. | |
| 2007/0238365 | A1 | 10/2007 | Hammond, Jr. et al. | |
| 2009/0269978 | A1 | 10/2009 | Pepe et al. | |
| 2011/0053431 | A1 | 3/2011 | Bopp et al. | |
| 2012/0184154 | A1 | 7/2012 | Straka et al. | |
| 2012/0329326 | A1 | 12/2012 | Caveney et al. | |

OTHER PUBLICATIONS

Extended European Search Report for Application No. 14763529.6 mailed Feb. 21, 2017.

* cited by examiner

CONNECTOR WITH CAPACITIVE CROSSTALK COMPENSATION TO REDUCE ALIEN CROSSTALK

CROSS-REFERENCE TO RELATED APPLICATIONS

This application claims the benefit of U.S. Provisional Patent Application Ser. No. 61/792,208, filed Mar. 15, 2013 and U.S. Provisional Patent Application Ser. No. 61/793,304, filed Mar. 15, 2013, which applications are hereby incorporated by reference in their entireties.

TECHNICAL FIELD

The present disclosure relates generally to telecommunications equipment. More particularly, the present disclosure relates to telecommunications connectors that are configured to incorporate balanced capacitive crosstalk compensation to reduce alien crosstalk generated from such a connector.

BACKGROUND

Electrical connectors, such as modular jacks and modular plugs, are commonly used in telecommunications systems. Such connectors may be used to provide interfaces between successive runs of cable in telecommunications systems and between cables and electronic devices. Electrical connectors may include contacts that are arranged according to know industry standards, such as Electronics Industries Alliance/Telecommunications Industry Association ("EIA/TIA")-568.

In the field of data communications, communications networks typically utilize techniques designed to maintain or improve the integrity of signals being transmitted via the network ("transmission signals"). To protect signal integrity, the communications networks should, at a minimum, satisfy compliance standards that are established by standards committees, such as the Institute of Electrical and Electronics Engineers (IEEE). The compliance standards help network designers provide communications networks that achieve at least minimum levels of signal integrity as well as some standard of compatibility.

One prevalent type of communication system uses twisted pairs of wires to transmit signals. In twisted pair systems, information such as video, audio and data are transmitted in the form of balanced signals over a pair of wires. The transmitted signal is defined by the voltage difference between the wires.

Crosstalk can negatively affect signal integrity in twisted pair systems. Crosstalk is unbalanced noise caused by capacitive and/or inductive coupling between wires and a twisted pair system. Crosstalk can exist in many variants, including near end crosstalk, far end crosstalk, and alien crosstalk. Near end crosstalk refers to crosstalk detected at the same end of a wire pair as the inductance/capacitance causing it, while far end crosstalk refers to crosstalk resulting from inductance/capacitance at a far end of a wire pair. Alien crosstalk refers to crosstalk that occurs between different cables (i.e. different channels) in a bundle, rather than between individual wires or circuits within a single cable. Alien crosstalk can be introduced, for example, at a multiple connector interface. With increasing data transmission speeds, increasing alien crosstalk is generated among cables, and must be accounted for in designing systems in which compensation for the crosstalk is applied. The effects of all crosstalk become more difficult to address with increased signal frequency ranges.

The effects of crosstalk also increase when transmission signals are positioned closer to one another. Consequently, communications networks include areas that are especially susceptible to crosstalk because of the proximity of the transmission signals. In particular, communications networks include connectors that bring transmission signals in close proximity to one another. For example, the contacts of traditional connectors (e.g., jacks and plugs) used to provide interconnections in twisted pair telecommunications systems are particularly susceptible to crosstalk interference. Furthermore, alien crosstalk has been observed that could not be explained by the current models which sum connector and cable component results to calculate channel results. This "excess" alien crosstalk is not compensated for in existing designs.

FIG. 1 shows a prior art panel 20 adapted for use with a twisted pair telecommunications system. The panel 20 includes a plurality of jacks 22. Each jack 22 includes a port 24 adapted to receive a standard telecommunications plug 26. Each of the jacks 22 is adapted to be terminated to four twisted pairs of transmission wires. As shown at FIG. 2, each of the jacks 22 includes eight contact springs labeled as having positions 1-8. In use, contact springs 4 and 5 are connected to a first pair of wires, the contact springs 3 and 6 are connected to a second pair of wires, contact springs 1 and 2 are connected to a third pair of wires, and contact springs 7 and 8 are connected to a fourth pair of wires. As shown at FIG. 3, a typical plug 26 also has eight contacts (labeled 1-8) adapted to interconnect with the corresponding eight contacts of the jack 22 when the plug is inserted within the port 24.

To promote circuit density, the contacts of the jacks and the plugs are required to be positioned in fairly close proximity to one another. Thus, the contact regions of the jacks and plugs are particularly susceptible to crosstalk. Furthermore, certain pairs of contacts are more susceptible to crosstalk than others. For example, the first and third pairs of contacts in the plugs and jacks are typically most susceptible to crosstalk.

To address the problems of crosstalk, jacks have been designed with contact spring configurations adapted to reduce the capacitive coupling generated between the contact springs so that crosstalk is minimized. An alternative approach involves intentionally generating crosstalk having a magnitude and phase designed to compensate for or correct crosstalk caused at the plug or jack. Typically, crosstalk compensation can be provided by manipulating the positioning of the contacts or leads of the jack or can be provided on a circuit board used to electrically connect the contact springs of the jack to insulation displacement connectors of the jack.

The telecommunications industry is constantly striving toward larger signal frequency ranges. As transmission frequency ranges widen, crosstalk becomes more problematic. Thus, there is a need for further development relating to crosstalk remediation.

SUMMARY

One aspect of the present disclosure relates to a telecommunications connector. The telecommunications connector includes a plurality of electrical conductors arranged in differential pairs and a circuit board having a plurality of conductive layers that provide a cross-talk compensation arrangement for applying capacitance between the electrical conductors. The conductive layers include a first, second, and third conductive layer, and a plurality of open-ended conductive paths that provide capacitive coupling at discrete capacitive coupling locations. The second conductive layer includes a conductive plate that is positioned between first and second discrete capacitive coupling locations, where the conductive plate has a first surface facing toward the first discrete capacitive coupling location and a second surface facing toward the second discrete capacitive coupling location. The first surface is adapted to reflect radiant energy from the first discrete capacitive coupling location back towards the first discrete capacitive coupling location to intensify the first capacitive coupling and the second surface is adapted to reflect radiant energy from the second discrete capacitive coupling location back towards the second discrete capacitive coupling location to intensify the second capacitive coupling, forming an electromagnetic shield between capacitive coupling locations.

The conductive plate can be either a non-ohmic or an ohmic plate and can be a localized plate that coincides with less that 25 percent of a total area defined by an outline of the circuit board. The conductive plate is electrically connected to a first open-ended conductive path, and the first open-ended conductive path is also electrically connected to capacitive elements provided at the first and second discrete capacitive coupling locations.

The capacitive elements may include capacitor fingers, and the first and second discrete capacitive coupling locations can include parallel capacitor fingers.

A further aspect of the present disclosure relates to a telecommunications connector including a plurality of electrical conductors arranged in differential pairs and a circuit board having a plurality of conductive layers: a first conductive layer, a second conductive layer and a third conductive layer. The circuit board includes a cross-talk compensation arrangement for applying capacitance between at least some of the electrical conductors, including a plurality of open-ended conductive paths with conductive pads provided at the first conductive layer. The open-ended conductive paths also include conductive vias that extend between the first, second and third conductive layers and that intersect the conductive pads, passing through the conductive plate without electrically connecting to the conductive plate and providing a first capacitive coupling at a first discrete capacitive coupling location at the third conductive layer. The second conductive layer includes a non-ohmic conductive plate having a first side that faces toward the first discrete capacitive coupling location and being relatively positioned such that the first side is adapted to reflect radiant energy from the first discrete capacitive coupling location back towards the first discrete capacitive coupling location to intensify the first capacitive coupling. Overlap is provided between the conductive plate and at least some of the conductive pads.

The first discrete capacitive coupling location includes capacitor fingers, and overlap is provided between the capacitive fingers and at least some of the conductive pads. The conductive via that passes through the conductive plate may intersect one of the capacitor fingers at an intermediate location along a length of the capacitor finger.

The electrical connector may be a jack, where the electrical conductors include contact springs having free ends and fixed ends, and the free ends of the contact springs can contact the conductive pads.

Another aspect of the present disclosure relates to a telecommunications jack with a front housing defining a plug port, a circuit board positioned within the front housing, and a first, second, third, fourth, fifth, sixth, seventh and eighth consecutively arranged electrical contact springs arranged in differential pairs. The circuit board has a plurality of conductive layers: a first conductive layer, a second conductive layer and a third conductive layer. The circuit board includes a cross-talk compensation arrangement for applying capacitance between at least some of the electrical contact springs, the cross-talk compensation arrangement including a plurality of open-ended conductive paths that provide a first capacitive coupling at a first discrete capacitive coupling location at the first conductive layer and a second capacitive coupling at a second discrete capacitive coupling location at the third conductive layer. The first capacitive coupling is applied between the third and fifth electrical contact springs and the second capacitive coupling being applied between the third and seventh electrical contact springs. The second conductive layer includes a conductive plate that is an ohmic plate electrically connected to the third electrical contact spring and positioned between the first and second discrete capacitive coupling locations. The conductive plate includes a first surface that faces toward the first discrete capacitive coupling location and an opposite second surface that faces toward the second discrete capacitive coupling location, the surfaces being relatively positioned such that the first surface is adapted to reflect radiant energy from the first discrete capacitive coupling location back towards the first discrete capacitive coupling location to intensify the first capacitive coupling, and the second surface is adapted to reflect radiant energy from the second discrete capacitive coupling location back towards the second discrete capacitive coupling location to intensify the second capacitive coupling.

The open-ended conductive paths of the cross-talk compensation arrangement include conductive vias that extend between the first, second and third conductive layers and intersect the conductive pads, providing a third capacitive coupling at a third discrete capacitive coupling location at the third conductive layer. The second conductive layer that is a non-ohmic conductive plate has a first side that faces toward the third discrete capacitive coupling location, the first side and the third discrete capacitive coupling location being relatively positioned such that the first side is adapted to reflect radiant energy from the third discrete capacitive coupling location back towards the third discrete capacitive coupling location to intensify the third capacitive coupling. Overlap is provided between the non-ohmic conductive plate and at least some of the conductive pads, where at least one of the conductive vias passes through the non-ohmic conductive plate without electrically connecting to the non-ohmic conductive plate. The third capacitive coupling is applied between the fourth and sixth electrical spring contacts.

The first, second and third discrete capacitive coupling locations each include capacitor fingers.

One aspect of the present disclosure relates to a telecommunications connector for use in a twisted pair system. The connector includes a plurality of electrical conductors arranged in differential pairs, and a circuit board including conductive tracks that electrically connect to the plurality of electrical conductors. The connector further includes a crosstalk compensation arrangement disposed on the circuit board and including a plurality of crosstalk compensating capacitances applied between electrical conductors associated with the differential pairs and selected such that, for each differential pair, a magnitude of an overall capacitance at a first electrical conductor of a differential pair is approximately equal to a magnitude of an overall capacitance at a second electrical conductor of the differential pair.

A further aspect of the present disclosure relates to a method that includes managing alien crosstalk at a first jack from a second jack. The method includes minimizing a difference in overall capacitance applied within the second jack to first and second electrical conductors of the same differential pair.

A still further aspect of the present disclosure includes a telecommunications connector for use in a twisted pair system. The telecommunications connector includes a plurality of electrical conductors arranged in differential pairs, and a circuit board including conductive tracks that electrically connect to the plurality of electrical conductors. The telecommunications connector also includes a crosstalk compensation arrangement disposed on the circuit board and including a plurality of crosstalk compensating capacitances applied between electrical conductors associated with the differential pairs. The plurality of crosstalk compensating capacitances are selected such that, for each differential pair, a difference in magnitudes of an overall capacitance at a first electrical conductor and an overall capacitance at a second electrical conductor of the differential pair is minimized.

A variety of additional inventive aspects will be set forth in the description that follows. The inventive aspects can relate to individual features and to combinations of features. It is to be understood that both the foregoing general description and the following detailed description are exemplary and explanatory only and are not restrictive of the broad inventive concepts upon which the embodiments disclosed herein are based.

DETAILED DESCRIPTION

Figure 1:
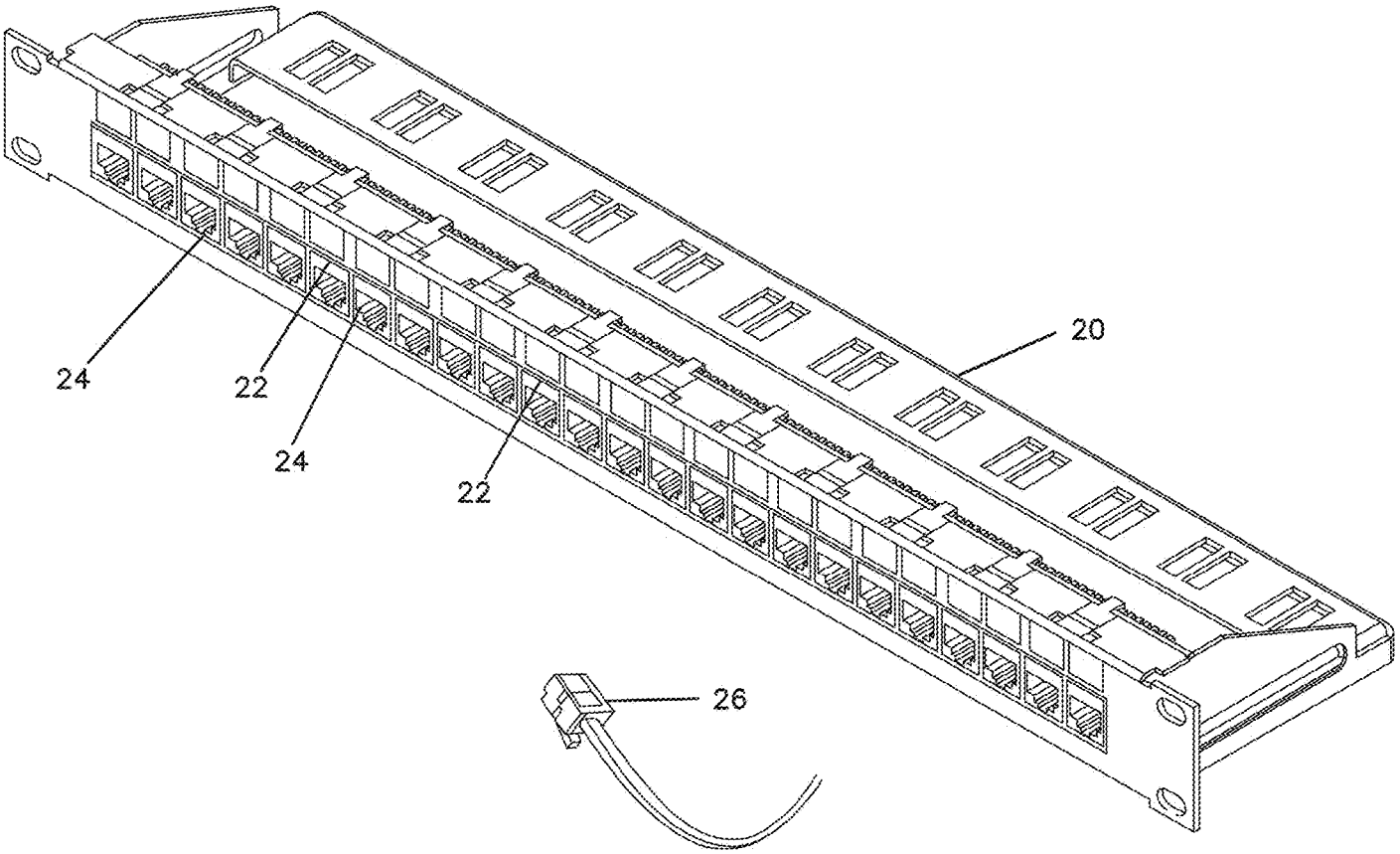
FIG. 1 PRIOR ART
FIG. 1 illustrates a prior art patch panel having modular RJ-45 jacks.
Figure 2:
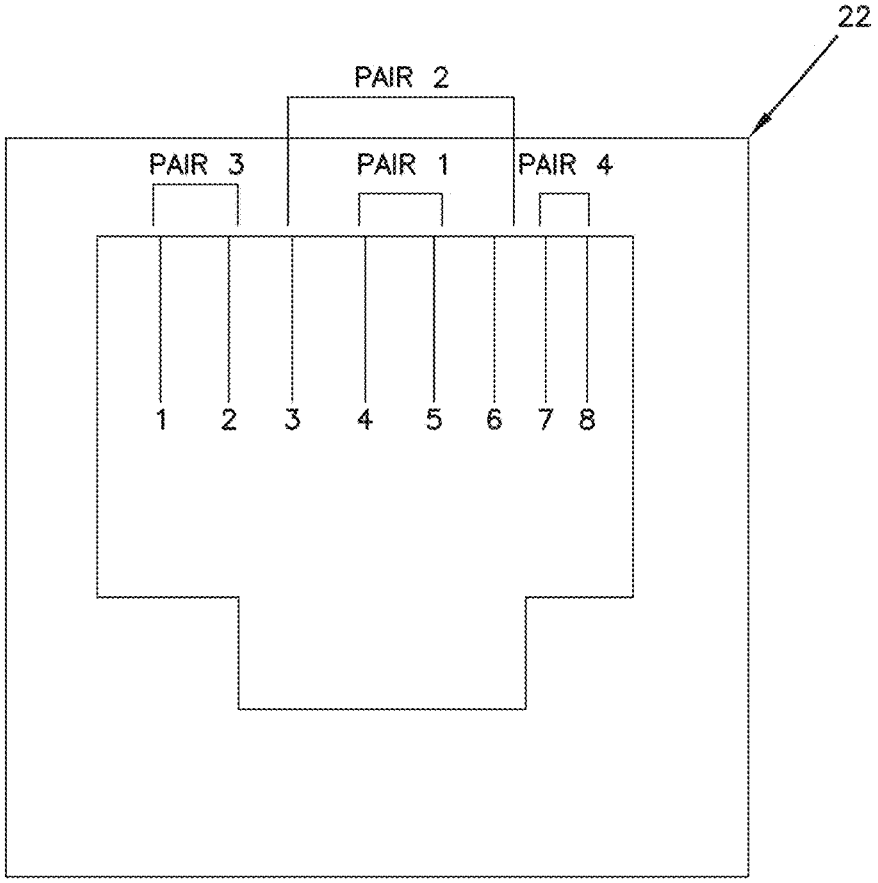
FIG. 2 PRIOR ART
FIG. 2 schematically depicts a contact layout for a standard modular RJ-24 jack.
Figure 3:
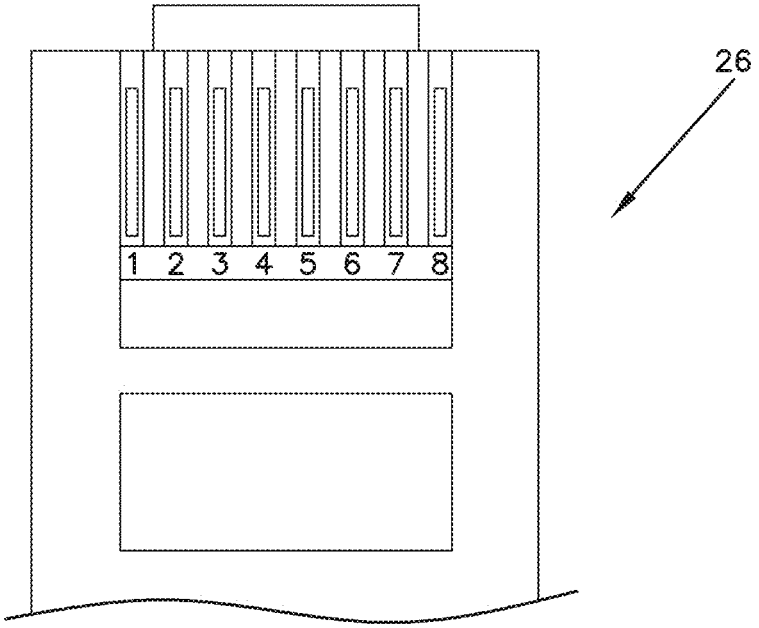
FIG. 3 PRIOR ART
FIG. 3 schematically illustrates a conventional pin layout for a standard RJ-45 jack.
Figure 4:
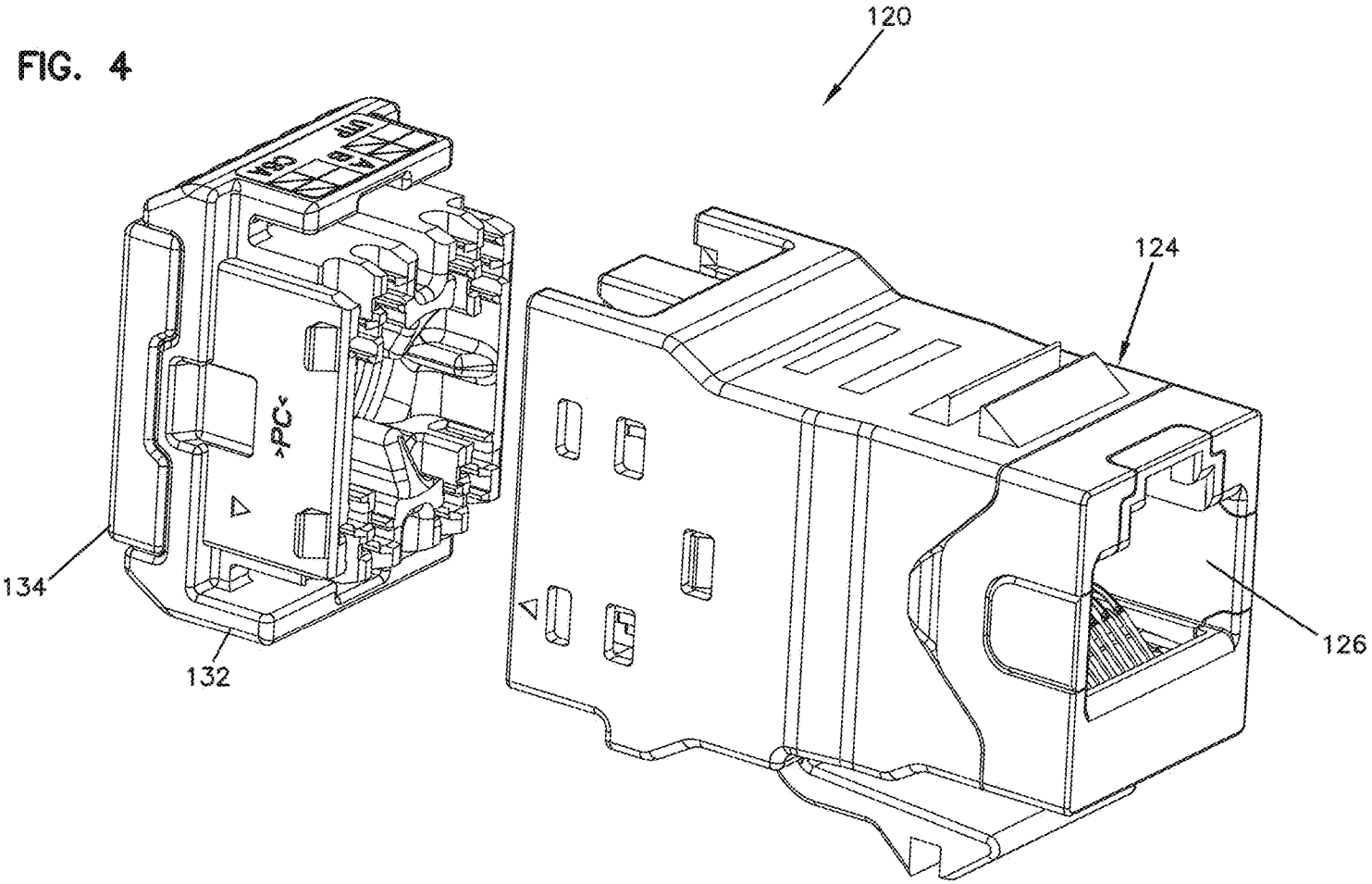
FIG. 4 is a front, partially exploded view of a telecommunications jack in accordance with the principles of the present disclosure.
Figure 5:
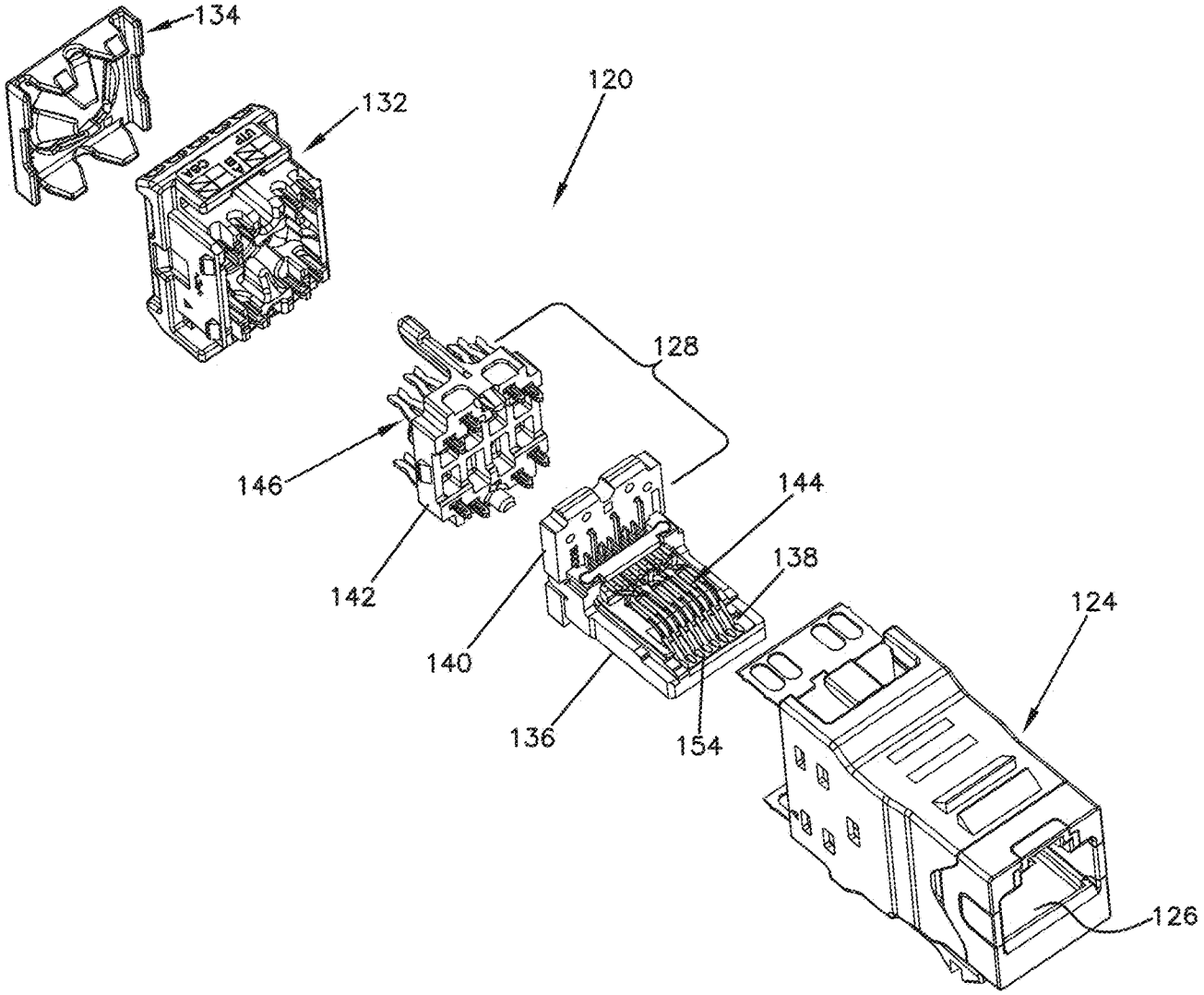
FIG. 5 is a front, more fully exploded view of the telecommunications jack of FIG. 4.

FIGS. 4 and 5 show a modular telecommunications jack 120 in accordance with the principles of the present disclosure. The telecommunications jack 120 is adapted to mate and electrically connect with a corresponding telecommunications plug 122 (see FIG. 8). In the depicted example, the telecommunications jack 120 and telecommunications plug 122 have a standard RJ-45 form factor and pin configuration. However, the subject matter described and/or illustrated herein is applicable to other types of electrical connectors whether the electrical connectors are modular jacks, modular plugs, or any other type of electrical connector.

Referring to FIG. 5, the telecommunications jack 120 includes a front housing 124 having a front port 126 that is keyed and sized to receive the telecommunications plug 122. The telecommunications jack 120 also includes a circuit insert assembly 128 that mounts (e.g., snap-fits) within the front housing 124 and a rear housing 132 that mounts adjacent to a rear side of the circuit insert assembly 128. The telecommunications jack 120 further includes a wire manager 134 that mounts to a rear side of the rear housing 134.

Figure 6:
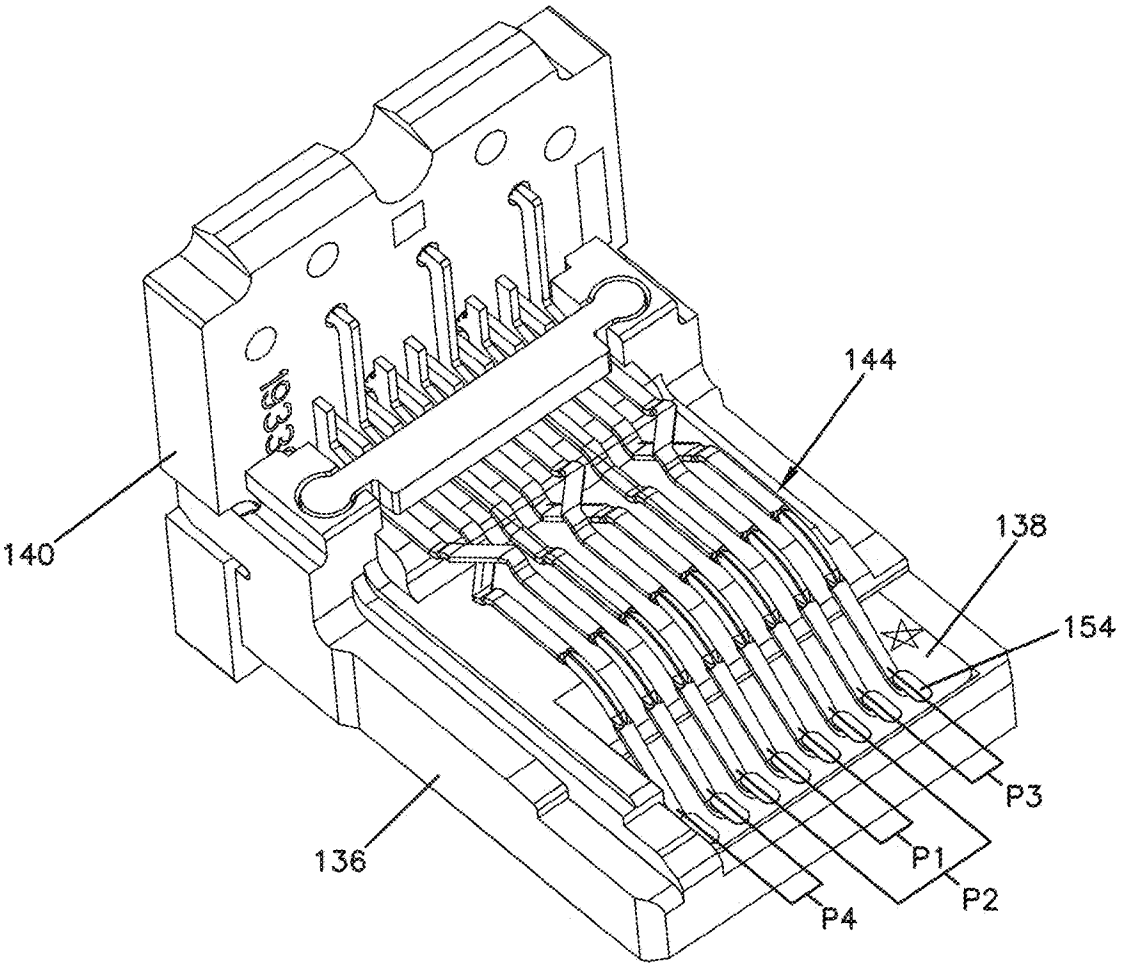
FIG. 6 is a front, perspective view of a circuit insert assembly of the telecommunications jack of FIG. 5.
Figure 7:
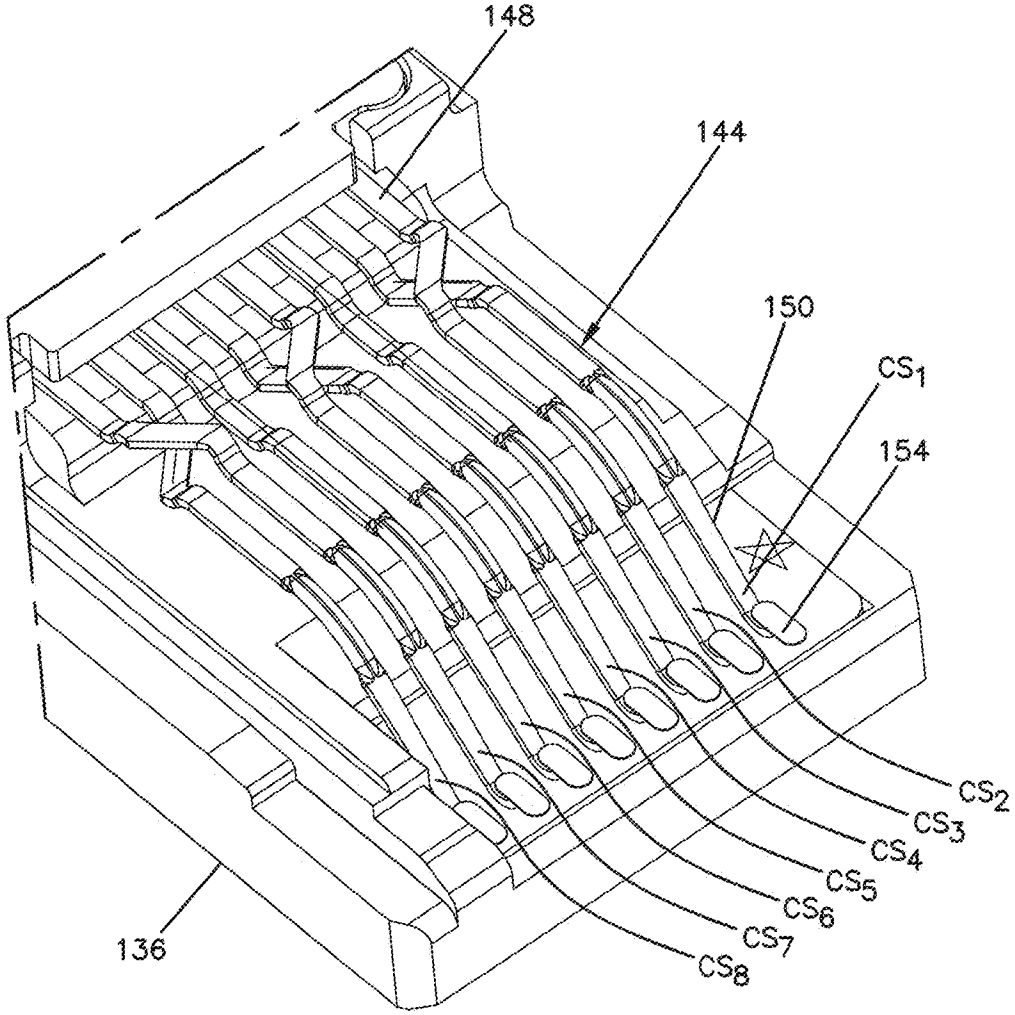
FIG. 7 is an enlarged view of a contact spring arrangement of the circuit insert assembly of FIG. 6.
Figure 9:
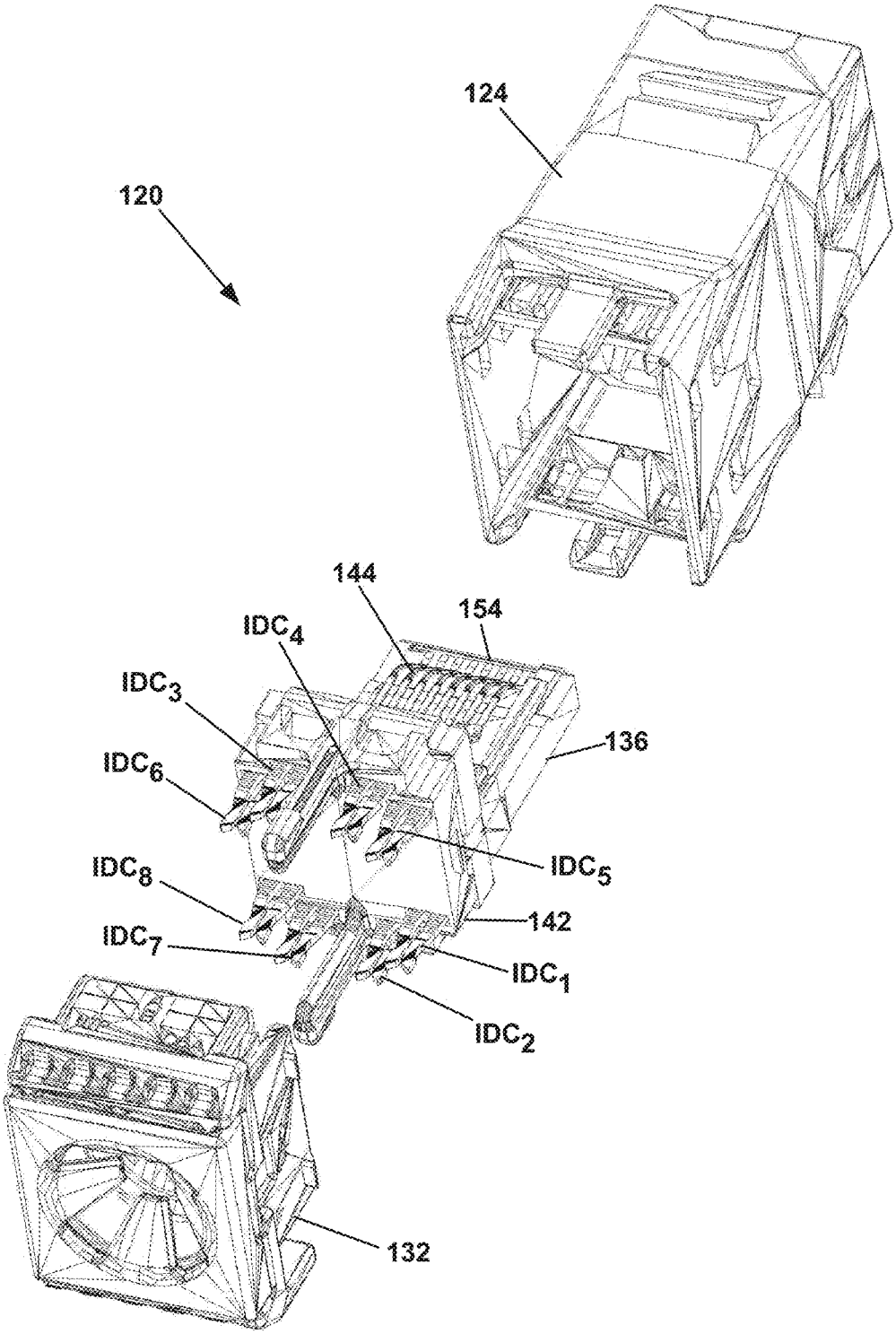
FIG. 9 is a rear, exploded view of the telecommunications jack of FIGS. 4 and 5.

The circuit insert assembly 128 includes a dielectric base 136, a first circuit board 138 (e.g., a horizontal circuit board) supported on the dielectric base 136, a second circuit board 140 (e.g., a vertical circuit board) arranged in an angle (e.g., a perpendicular angle) relative to the first circuit board 138, and a termination support 142 mounted to a back side of the second circuit board 140. The circuit insert assembly 128 also includes contact springs 144 and wire termination structures 146. The contact springs 144 include eight contact springs numbered $CS_1$-$CS_8$ (see FIG. 7). The wire termination structures 146 are depicted as insulation displacement connectors but could be other types of wire termination structures such as wire wraps or pins. The wire termination structures 146 include eight wire termination structures labeled $IDC_1$-$IDC_8$ (see FIG. 9). The contact springs $CS_1$-$CS_8$ are respectively electrically connected to the wire termination structures $IDC_1$-$IDC_8$. In certain examples, the arrangement of contact springs 144 may be at least partially determined by industry standards, such as, but not limited to, International Electrotechnical Commission (IEC) 60603-7 or Electronics Industries Alliance/Telecommunications Industry Association (EIA/TIA)-568. In certain examples, the contact springs 144 include eight contact springs arranged as differential pairs P1-P4 (see FIG. 6). Each differential pair P1-P4 may consist of two paired contact springs 144 in which one contact spring 144 of the pair transmits a current signal and the other contact spring 144 of the pair transmits a current signal that is 180 degrees out of phase with the paired contact spring. By convention, the differential pair P1 includes contact springs $CS_4$ and $CS_5$; the differential pair P2 includes contact springs $CS_3$ and $CS_6$; the differential pair P3 includes contact springs $CS_1$ and $CS_2$; and the differential pair P4 includes contact springs $CS_7$ and $CS_8$.

Figure 8:
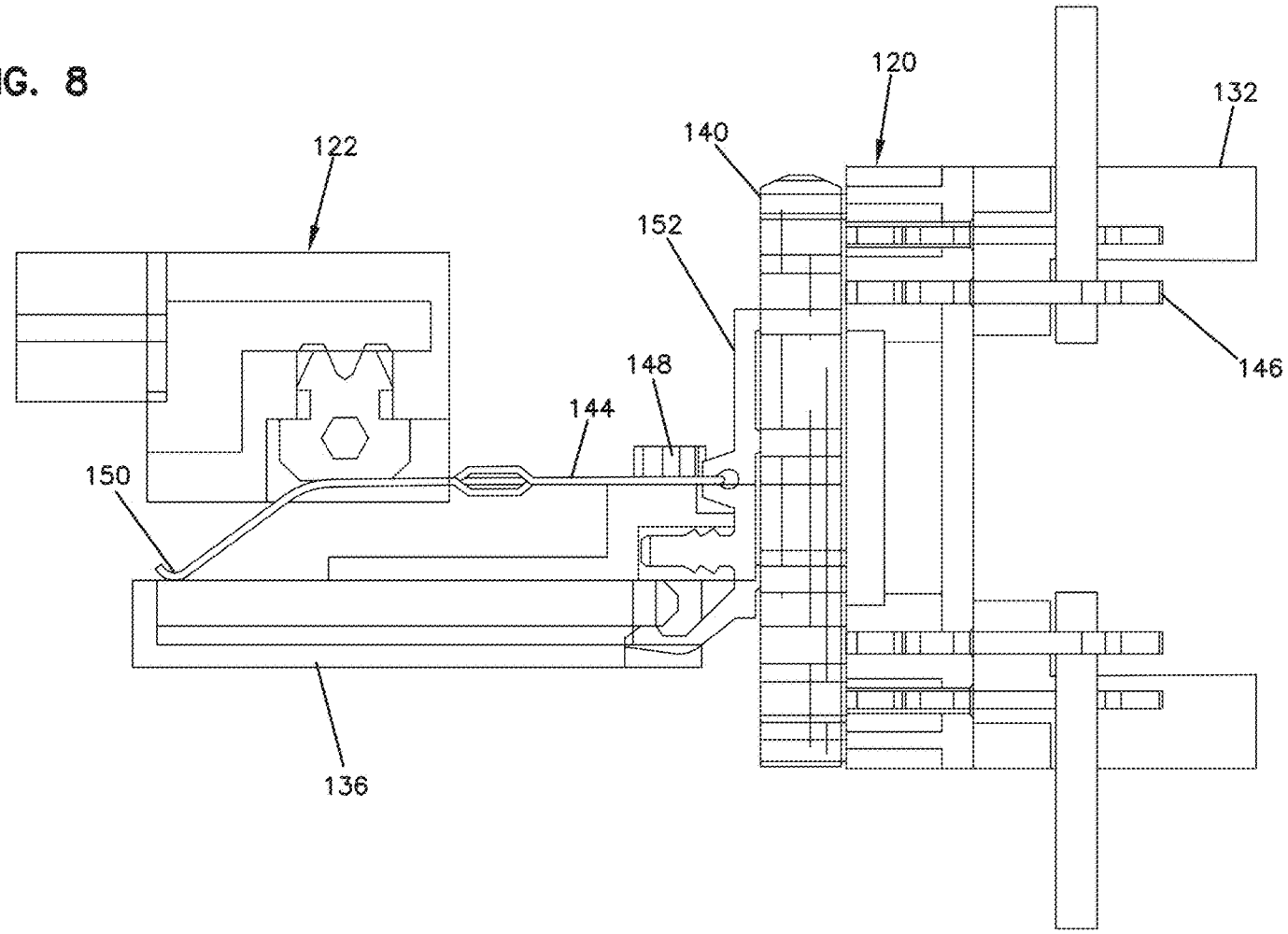
FIG. 8 is a schematic view showing the telecommunications jack of FIGS. 4 and 5 mated with a telecommunications plug.

The contact springs 144 include fixed ends 148 and free ends 150 (see FIG. 8). The fixed ends 150 are anchored relative to the dielectric base 136 and are electrically connected to the second circuit board 140 by electrical connection member 152. The free ends 150 of the contact spring 144 engage top conductive pads 154 (see FIGS. 7 and 10) provided at a top side of the first circuit board 138. The electrical connector members 152 and conductive traces provided on the second circuit board 140 function to electrically connect each of the contact springs $CS_1$-$CS_8$ to a respective one of the wire termination structures $IDC_1$-$IDC_8$. The electrical connection members 152 also function to electrically connect selected ones of the contact springs 144 (e.g., contact springs $CS_2$, $CS_4$ and $CS_7$) to respective bottom conductive pads 156 (see FIG. 10) provided at a bottom side of the first circuit board 138. The top conductive pads 154 can include top conductive pads $TCP_1$-$TCP_8$ (see FIG. 10) that respectively correspond to each of the contact springs $CS_1$-$CS_8$. Also, the bottom conductive pads 156 can include bottom conductive pads $BCP_2$, $BCP_4$ and $BCP_7$ (see FIG. 10) that respectively correspond to contact springs $CS_2$, $CS_4$ and $CS_7$. The electrical connection members 152 can also function to mechanically connect the dielectric base 136 to the second circuit board 140.

The rear housing 132 of the telecommunications jack 120 can be configured to mount adjacent to the back side of the termination support 142. In one example, the rear housing 132 is configured to house the wire contact structures 146. In one example, the rear housing 132 can snap-fit to the front housing 124 at a location behind the termination support 142.

The circuit insert assembly 128 is loaded into the front housing 124 by inserting the circuit insert assembly 128 into the front housing 124 through a rear end 158 of the front housing 124. When the circuit insert assembly 128 is fully loaded and retained within the front housing 124, the contact springs $CS_1$-$CS_8$ are positioned so as to be accessible at the front port 126. In this way, when the telecommunications plug 122 is inserted within the front port 126, paired contacts of the telecommunications plug 122 engage and are electrically connected to corresponding contact springs $CS_1$-$CS_8$ of the jack 120. After the circuit insert assembly 128 is snapped within the front housing 124, the rear housing 132 can be snapped in place. Alternatively, the rear housing 132 and the circuit insert assembly 128 can be secured together and then loaded into the front housing 124 as a unit.

Figure 16:
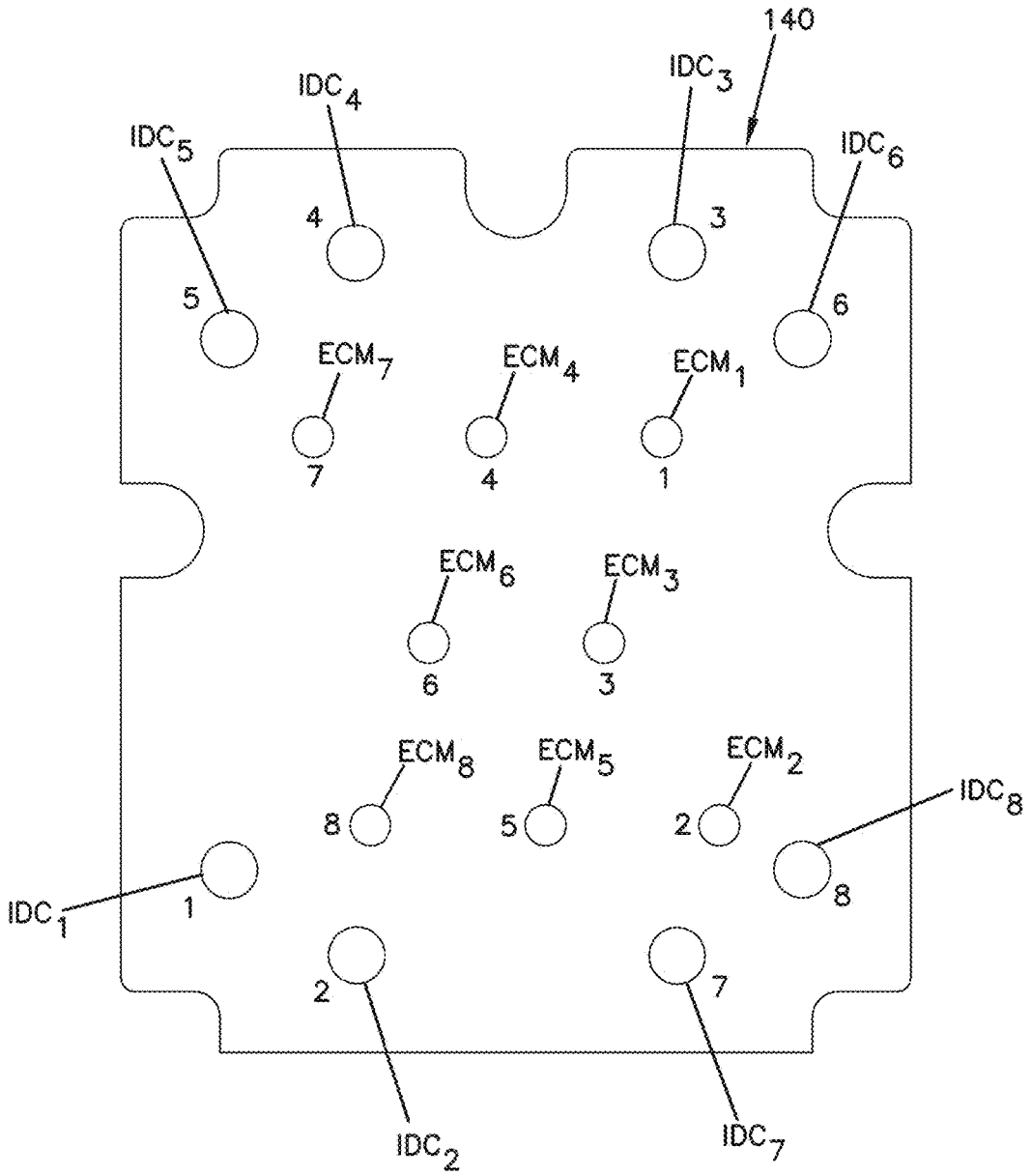
FIG. 16 shows an IDC and electrical connection member lay-out for the vertical circuit board of the jack of FIGS. 4 and 5.

The electrical connection members 152 include a plurality of electrical connection members $ECM_1$-$ECM_8$ that respectfully correspond to the contact springs $CS_1$-$CS_8$ and the wire termination structures $IDC_1$-$IDC_8$. It will be appreciated that the second circuit board 140 can include a multi-layer construction having conductive paths (e.g., circuit tracings, tracks) that electrically connect the electrical connection members $ECM_1$-$ECM_8$ respectively to the wire termination structures $IDC_1$-$IDC_8$. A layout of the electrical connection members $ECM_1$-$ECM_8$ and the wire termination structures $IDC_1$-$IDC_8$ on the second circuit board 140 is shown at FIG. 16.

The telecommunications jack 120 includes structure for compensating for crosstalk (e.g., near end crosstalk and/or far end crosstalk). For example, compensating capacitance can be provided by crossing over selected ones of the contact springs $CS_1$, $CS_8$ to run lengths of selected contact springs adjacent to one another. Additionally, discrete capacitors can be integrated within the first circuit board 138 and/or the second circuit board 140 to provide discrete capacitive coupling locations. In one example, capacitive couplings for compensating for crosstalk are provided primarily by capacitive couplings generated at the contact springs 140 and by discrete capacitive couplings provided at the first circuit board 138.

Figure 15:
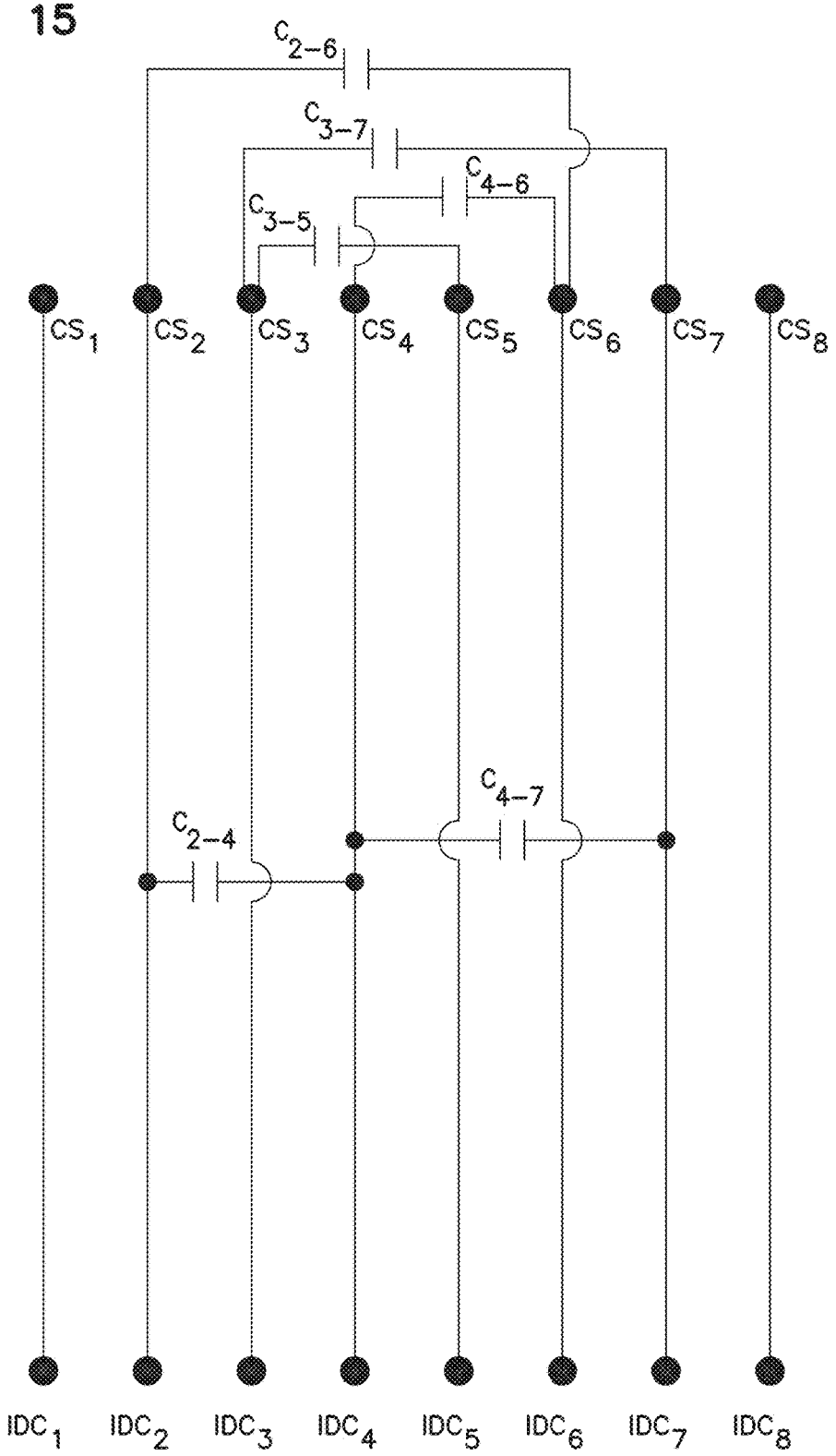
FIG. 15 schematically shows various discrete capacitive couplings of the telecommunications jack of FIGS. 4 and 5.

FIG. 15 shows an arrangement of discrete capacitive couplings provided by the first printed circuit board 138 of the jack 120 to compensate for unwanted crosstalk. The arrangement of capacitive couplings is shown including a discrete capacitive coupling $C_{3-5}$ between the contact spring $CS_3$ of the differential pair P2 and the contact spring $CS_5$ of the differential pair P1. A discrete capacitive coupling $C_{3-7}$ is provided between the contact spring $CS_3$ of the differential pair P2 and the contact spring $CS_7$ of the differential pair P4. A discrete capacitive coupling $C_{4-6}$ is provided between the contact spring $CS_4$ of the differential pair P1 and the contact spring $CS_6$ of the differential pair P2. Moreover, a discrete capacitance $C_{4-7}$ is provided between the contact spring $CS_4$ of the differential pair P1 and the contact spring $CS_7$ of the differential pair P4. Additionally, a discrete capacitance $C_{2-4}$ is provided between the contact spring $CS_2$ of the differential pair P3 and the contact spring $CS_4$ of the differential pair P1. Also, a discrete capacitance $C_{2-6}$ is provided between the contact spring $CS_2$ of the differential pair P3 and the contact spring $CS_6$ of the differential pair P2.

It will be appreciated that in a telecommunications jack, there is limited space for providing the required levels of capacitance needed to fully address and remedy offending crosstalk. In this regard, aspects of the present disclosure relate to features for enhancing the effective use of space within the jack by using conductive plates (e.g., ohmic plates or non-ohmic plates) to intensify the capacitive coupling provided at discrete capacitive coupling sites. In certain examples, a conductive plate can be used to intensify discrete capacitive couplings provided at opposite sides of the conductive plate. In certain examples, conductive plates and/or discrete capacitive coupling locations can be provided directly at vias that intersect conductive pads in contact with the free ends of the contact springs. In certain examples, the conductive plates can be non-ohmic plates defining openings for allowing vias that intersect the top conductive pads of the first circuit board 138 to pass through the non-ohmic plates. In certain examples, a via that intersects one of the top conductive pads 154 can also intersect a discrete capacitive element (e.g., a plate or finger) at an intermediate location along the discrete capacitive element. Aspects of the present disclosure also relate to open-ended paths having relatively high levels of capacitance and relatively short electrical lengths.

As used herein, the term "non-ohmic plates" refers to electrically conductive plates that are not directly connected to any conductive material, such as traces, conductive pathways or ground, that may be in the telecommunications jack 120. The non-ohmic plates may be positioned adjacent to open-ended traces/conductive paths within the circuit boards. As used herein, the term "open-ended" refers to conductive paths that do not extend along or form a portion of the signal or return paths $CP_1$-$CP_8$ (i.e., the conductive paths do not carry a current when the telecommunications jack 120 is operational.)

Figure 10:
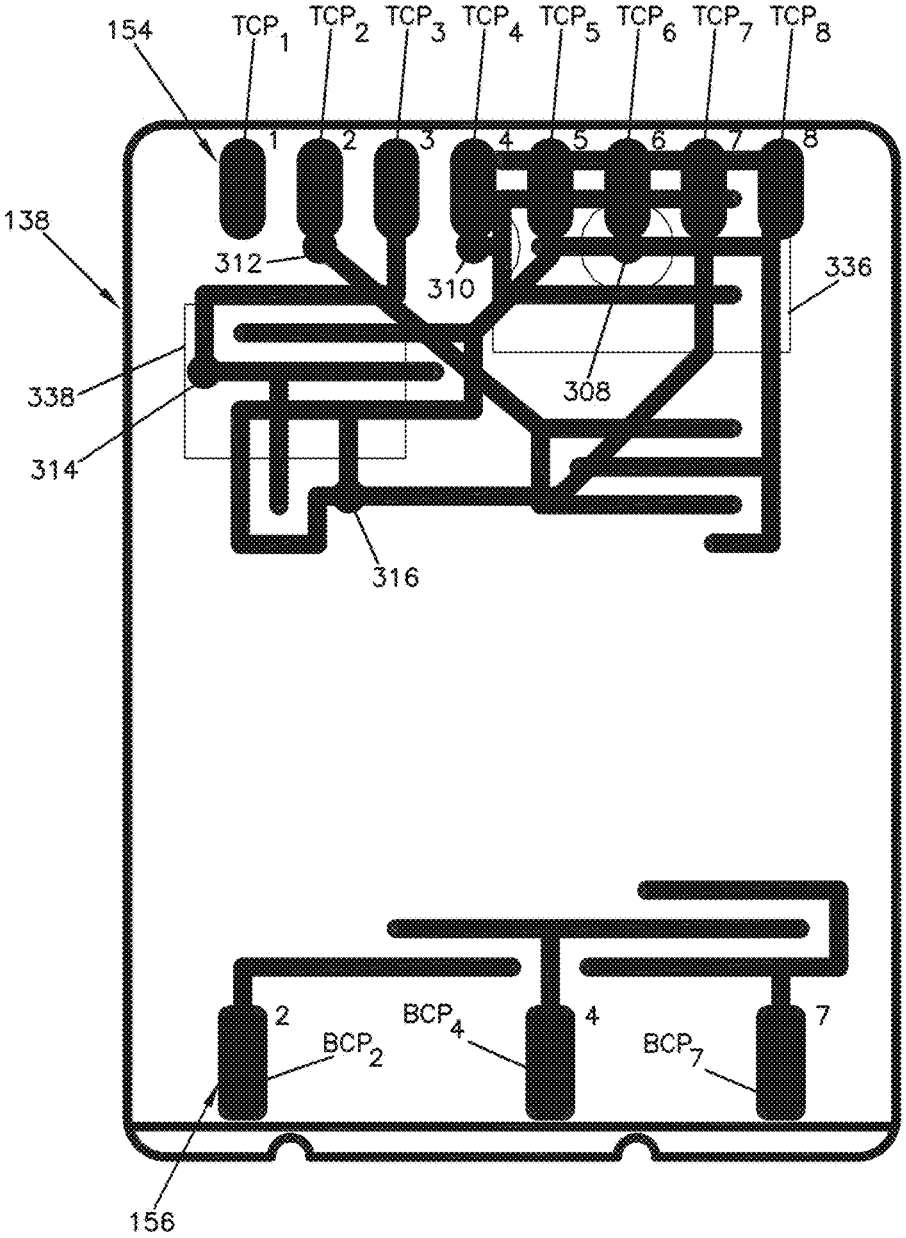
FIG. 10 shows an overall conductive pathway layout of a compensation circuit board of the telecommunications jack of FIGS. 4 and 5.
Figure 11:
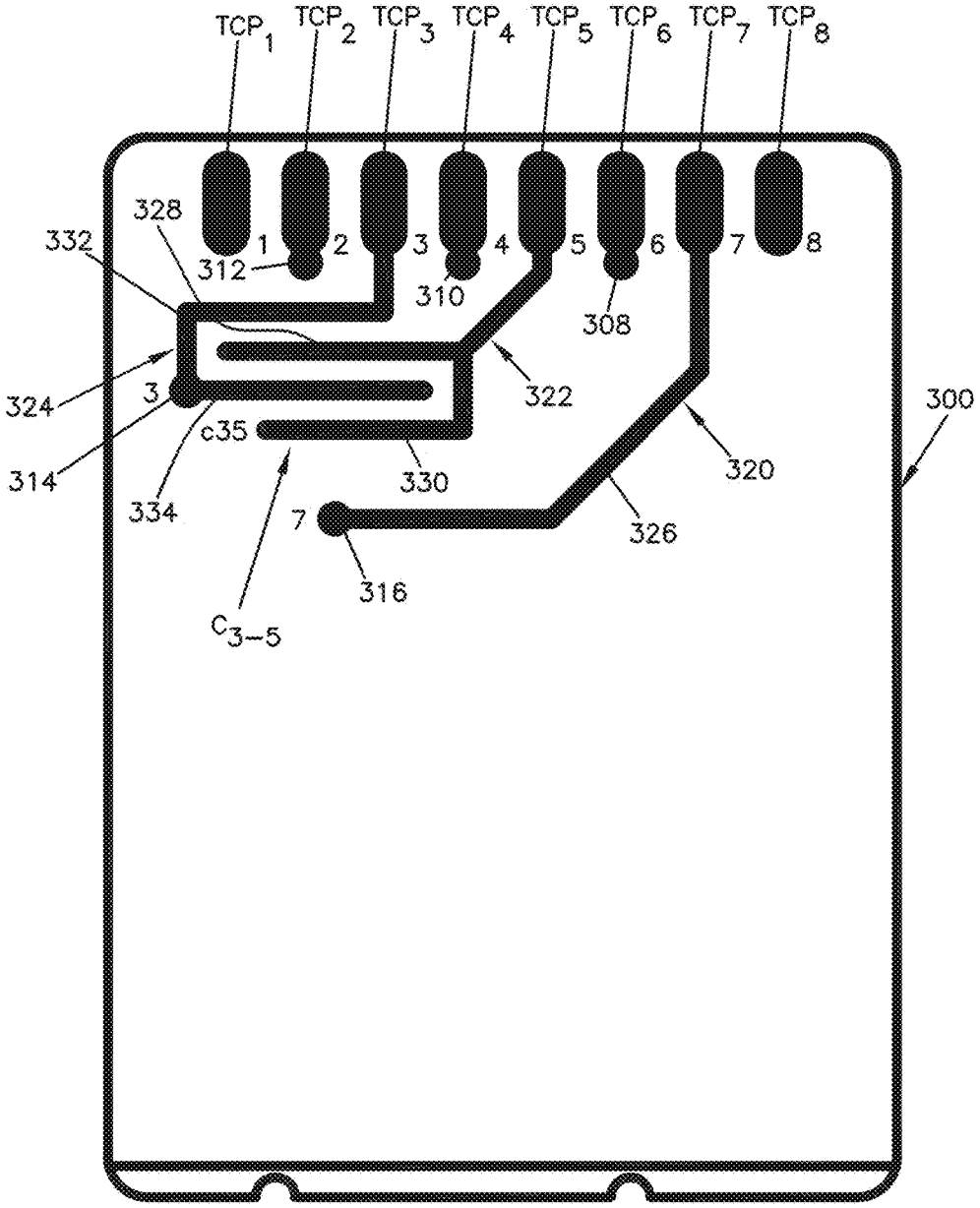
FIG. 11 shows a conductive pathway layout for a top layer of the compensation circuit board of FIG. 10.
Figure 13:
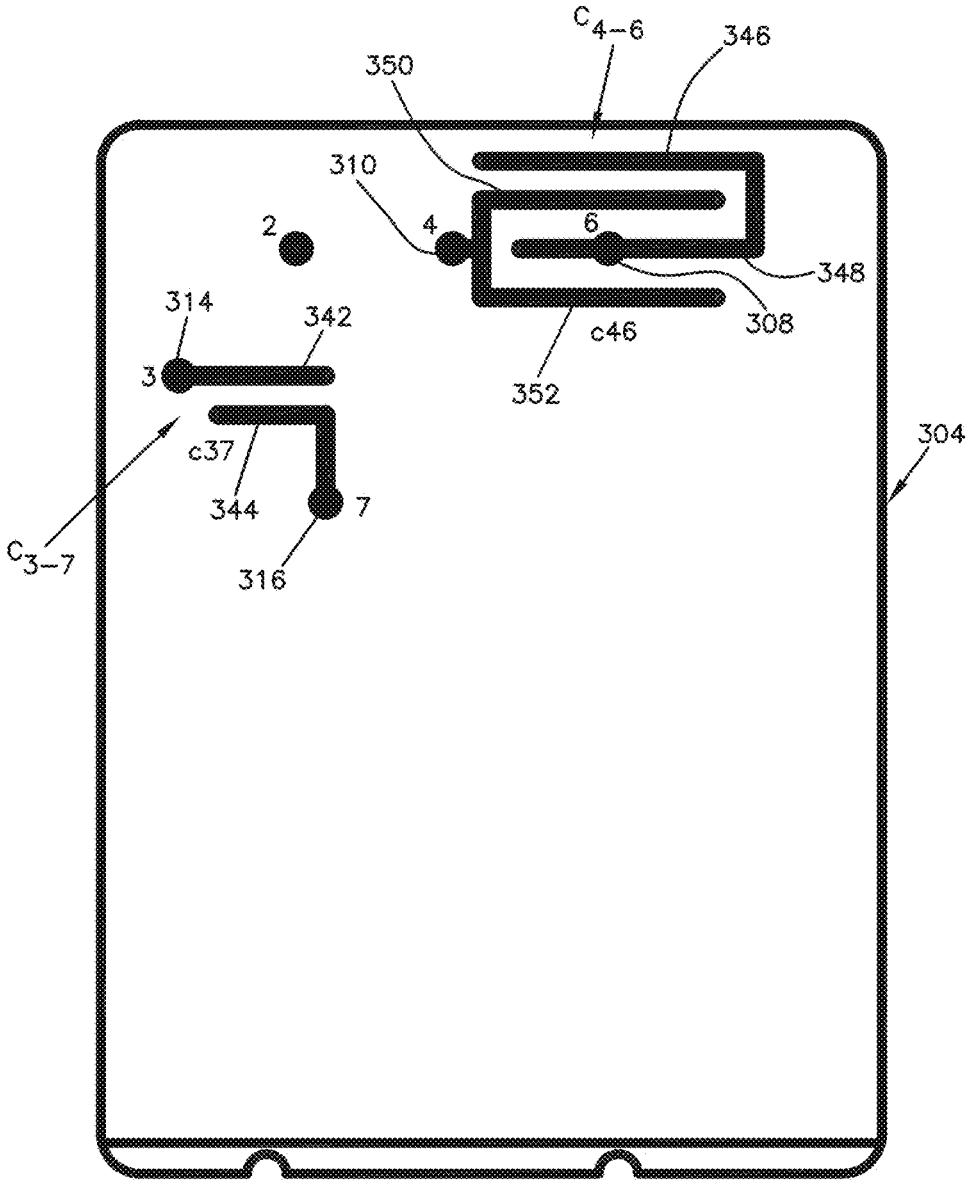
FIG. 13 shows a conductive pathway layout for a second inner layer of the compensation circuit board of FIG. 10.
Figure 14:
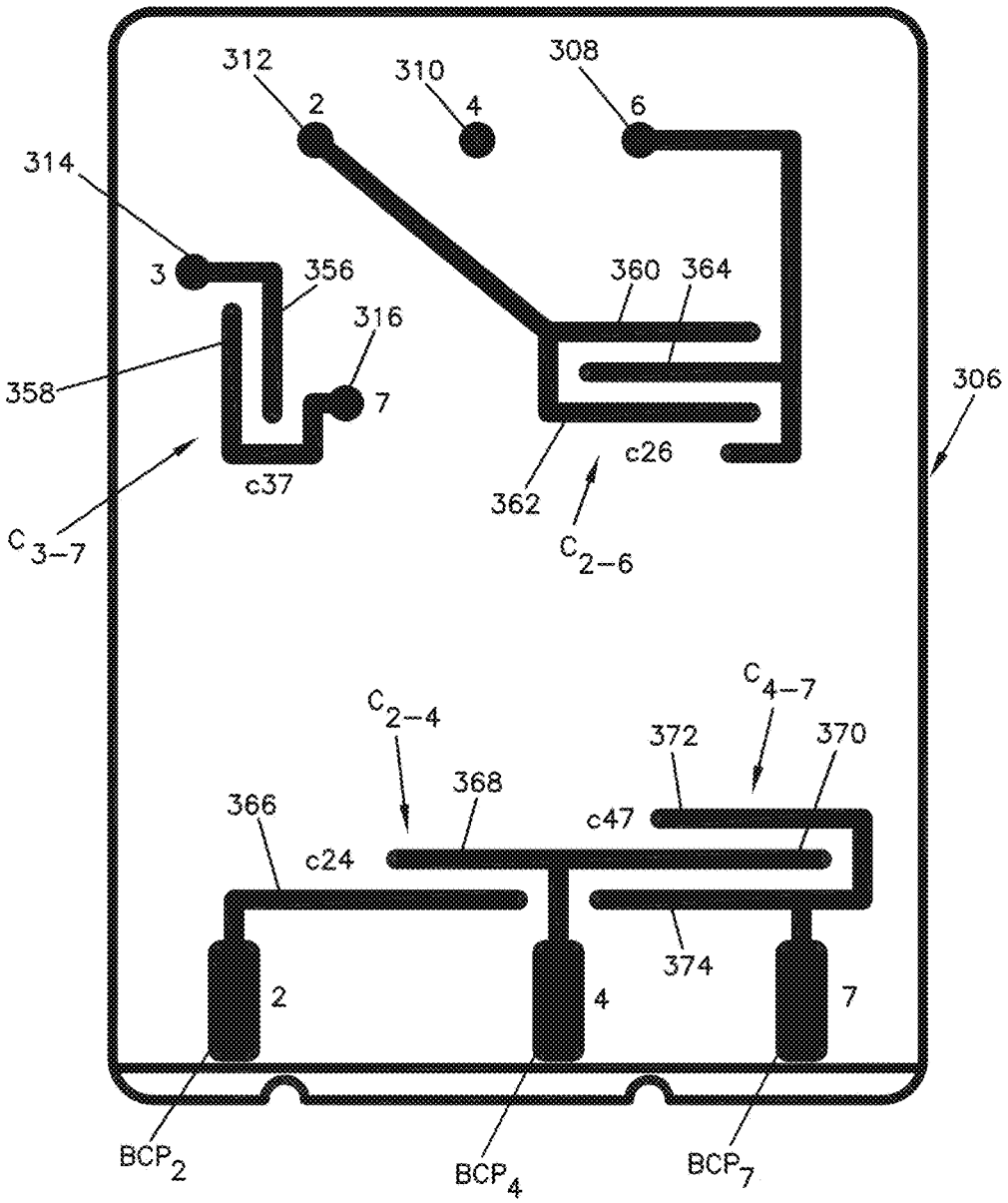
FIG. 14 shows a conductive pathway layout for a bottom layer of the compensation circuit board of FIG. 10.

The first circuit board 138 includes a top layer 300 (see FIG. 11), a first inner layer 302 (see FIG. 12), a second inner layer 304 (see FIG. 13) and a bottom layer at 306 (see FIG. 14). FIG. 10 shows an overlay of all the layers 300, 302, 304 and 306. The first inner layer 302 is positioned between the top layer 300 and the second inner layer 304. The second inner layer 304 is positioned between the first inner layer 302 and the bottom layer 306. The first circuit board 138 also includes a plurality of electrically conductive vias that extend through the first circuit board 138 between the various layers of the first circuit board 138. For example, the first circuit board 138 includes a first via 308, a second via 310, a third via 312, a fourth via 314 and a fifth via 316. The first via 308 intersects the pad $TCP_6$, the second via 310 intersects the pad $TCP_4$ and the third via 312 intersects the pad $TCP_2$.

The top layer 300 includes the top conductive pads $TCP_1$-$TCP_8$. The top layer 300 also includes at least portions of a first open-ended conductive path 320, a second open-ended conductive path 322 and a third open-ended conductive path 324. With regard to the first open-ended conductive path 320, a segment 326 of the first open-ended conductive path 320 is provided on the top layer 300. The segment 326 extends from the top conductive pad $TCP_7$ to the fifth via 316. The second open-ended conductive path 322 is electrically connected to the top conductive pad $TCP_5$ and includes two capacitive fingers 328, 330. The second open-ended conductive path 322 is provided completely at the top layer 300. The third open-ended conductive path 324 includes a segment 332 and a capacitive finger 334 provided at the top layer 300. The segment 332 extends from the top conductive pad $TCP_3$ to the via 314 and the capacitive finger 334 extends from the via 314 between the capacitive fingers 328, 330. The capacitive fingers 328, 330 cooperate with the capacitive finger 334 to provide the discrete capacitive coupling $C_{3-5}$.

Figure 12:
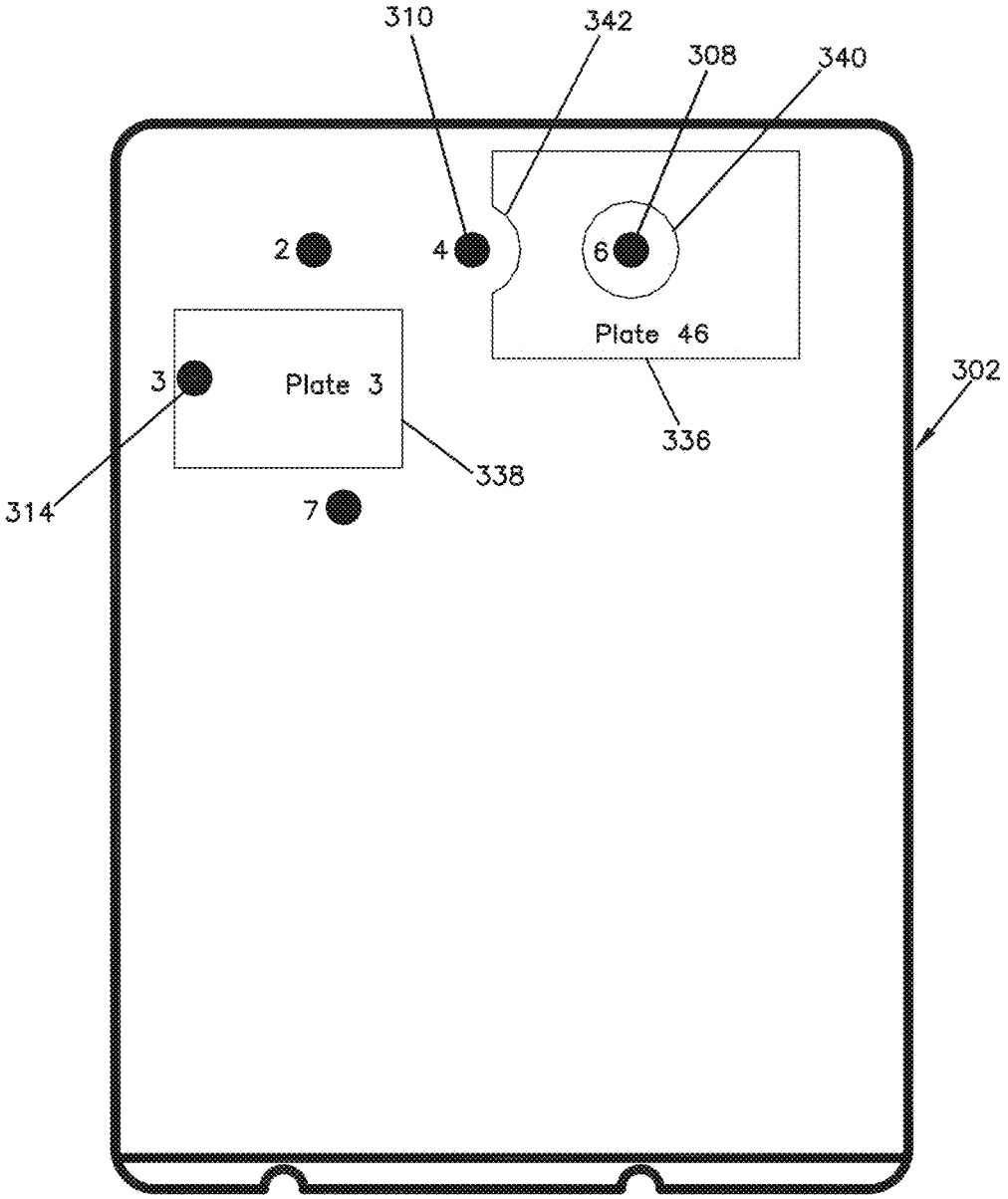
FIG. 12 shows a conductive pathway layout for a first inner layer of the compensation circuit board of FIG. 10.

Referring to FIG. 12, the first inner layer 302 includes a conductive plate 336 and a conductive plate 338. In one example, conductive plate 336 is non-ohmic and the conductive plate 338 is ohmic. The conductive plate 338 could also be non-ohmic. As shown at FIG. 12, the conductive plate 338 is intersected by the via 314 and is electrically connected to the via 314. Thus, the conductive plate 338 is part of the second open-ended conductive path 322. The first via 308 passes through the conductive plate 336 without being electrically connected to the conductive plate 336. For example, the conductive plate 336 defines an opening 340 that surrounds the via 308 and that is larger than the via 308 so that no electrical contact is made between the conductive plate 336 and the via 308. The conductive plate 336 also includes a recess 342 for preventing electrical contact between the conductive plate 336 and the via 310. It will be appreciated that the conductive plate 336 is positioned such that overlap exists between the conductive plate 336 and at least some of the front conductive pads 154. For example, in the depicted example, overlap exists between the conductive plate 336 and the top conductive pads $TCP_5$-$TCP_8$ (see FIG. 10). It will be appreciated that a dielectric layer is provided between the top layer 300 and the first inner layer 302 to prevent an electrical contact between the conductive plate 336 and the top conductive pads $TCP_5$-$TCP_8$.

Overlap also exists between the conductive plate 338 and the capacitive fingers 328, 330 and 334 (see FIG. 10). Since the dielectric layer is present between the top layer 300 and the first inner layer 302, no direct electrical contact is made between the conductive plate 338 and the capacitive fingers 328, 330 and 334. A first side (e.g., a top side) of the conductive plate 338 faces toward the capacitive fingers 328, 330 and 334. The first side of the conductive plate 338 capacitively couples with the capacitive fingers 328, 330 to intensify the capacitive coupling provided at the discrete capacitance $C_{3-5}$. Additionally, through radiant energy reflection, the first side of the electrically connective plate 338 intensifies the capacitive coupling provided between the capacitive finger 334 and the capacitive fingers 328, 330.

The second inner layer 304 is separated from the first inner layer 302 by a dielectric layer. As shown at FIG. 13, the second inner layer 304 includes a capacitive finger 342 that is electrically connected to the via 314 and is therefore part of the open-ended conductive path 324. The second inner layer 304 also includes a capacitive finger 344 that is electrically connected to the via 316 and is therefore part of the open-ended conductive path 320. The capacitive fingers 342, 344 are parallel to one another and closely spaced relative to one another so as to provide the discrete capacitive couplings $C_{3-7}$. The conductive plate 338 overlaps the capacitive fingers 342, 344. A second side (e.g., a bottom side) of the connective plate 338 faces toward the conductive fingers 342, 334. The second side of the conductive plate 338 provides a capacitive coupling with the capacitive finger 344 to intensify the magnitude of the discrete capacitance $C_{3-7}$. Additionally, the second side of the conductive plate 338 reflects radiant energy back toward the capacitive fingers 342, 344 thereby intensifying the capacitive coupling provided between the capacitive fingers 342, 344. Thus, by reflection and capacitive coupling, the conductive plate 338 assists in intensifying the magnitude of the capacitive coupling $C_{3-7}$. Additionally, because the conductive plate 338 is positioned between the capacitive finger 344 and the capacitive fingers 328, 330, unwanted capacitive coupling between the capacitive finger 344 and the capacitive fingers 328, 330 is prevented. In this way, the conductive plate 338 provides a shielding effect.

Still referring to FIG. 13, the second inner layer 304 also includes capacitive fingers 346, 348 electrically connected to the top conductive pad $TCP_6$ by the via 308. The via 308 intersects the capacitive finger 348 at an intermediate location along the length of the capacitive finger 348. Capacitive fingers 350, 352 are electrically connected to the top conductive pad $TCP_4$ by the via 310. The capacitive finger 346 is positioned between the capacitive fingers 348 and 350. The capacitive finger 348 is positioned between the capacitive fingers 350, 352. The capacitive fingers 346, 348, 350 and 352 cooperate to provide the discrete capacitance $C_{4-6}$. The conductive plate 336 overlaps the capacitive fingers 346, 348, 350 and 352 (see FIG. 10). A bottom side of the conductive plate 336 faces toward the capacitive fingers 346, 348, 350 and 352 and reflects radiant energy back toward the fingers 346, 348, 350 and 352 to intensify the capacitive coupling provided between the capacitive fingers 346, 348, 350 and 352. Additionally, the conductive plate 336 provides a shielding effect for shielding unwanted capacitive couplings between the capacitive fingers 346, 348, 350 and 352 and the top conductive pads $TCP_5$-$TCP_8$.

As shown at FIG. 14, the bottom layer 306 of the first circuit board 138 includes a capacitive finger 356 that is electrically connected to the via 314 and a capacitive finger 358 that is electrically connected to the via 316. Thus, the capacitive finger 356 is part of the third open-ended conductive path 324 and the capacitive finger 358 is part of the first open-ended connective path 320. The capacitive fingers 356, 358 are parallel to one another and closely spaced from one another so as to provide a capacitive coupling therebetween. The capacitive coupling provided between the capacitive fingers 356, 358 is part of the discrete capacitive coupling $C_{3-7}$. The bottom layer 306 also includes capacitive fingers 360, 362 electrically connected to the via 312 and a capacitive finger 364 electrically connected to the via 308. The capacitive fingers 360, 362 and 364 are parallel and the capacitive finger 364 is positioned between the capacitive fingers 360, 362. The capacitive fingers 360, 362 and 364 cooperate to provide the discrete capacitive coupling $C_{2-6}$.

The bottom pads $BCP_2$, $BCP_4$ and $BCP_7$ are provided at the bottom layer 306. The bottom layer 306 further includes capacitive fingers 366, 368, 370, 372 and 374. The capacitive finger 366 is electrically connected to the bottom conductive pad $BCP_2$. The capacitive fingers 368, 370 are electrically connected to the bottom conductive pad $BCP_4$. The capacitive fingers 372, 374 are electrically connected to the bottom conductive pad $BCP_7$. The conductive fingers 366, 368 are parallel and cooperate to define the capacitive coupling $C_{2-4}$. The capacitive fingers 370, 372 and 374 are parallel and the capacitive finger 370 is positioned between the capacitive fingers 372, 374. The capacitive fingers 370, 372 and 374 cooperate to provide the capacitive coupling $C_{4-7}$.

In certain examples described herein, the depicted layers (e.g., FIGS. 11-14) are conductive layers that can be separated by dielectric layers. In certain examples, the conductive plates are discrete, localized plates that each coincide with only a relatively small portion of the overall area defined by the outer shape/footprint of the circuit board. In certain examples, each conductive plate coincides with less than 25 percent or less than 10 percent of the overall area defined by the outer shape/footprint of the circuit board. As used herein, the terms "first", "second" and "third" when applied to conductive layers do not require the layers to be consecutive (i.e., the second layer is not required to be between the first and third layers). Also, as used herein, the terms "first", "second", "third" and "fourth", when applied generally to differential pairs, do not require the pairs to be limited to a particular known 8-pin pairing convention. In other words, the phrase "first pair" can cover any differential pair and is not limited to pair 1 (e.g., contacts 4 and 5) of a conventional 8-pin pairing; the phrase "second pair" can cover any differential pair and is not limited to pair 2 (e.g., contacts 3 and 6) of a conventional 8-pin pairing; the phrase "third pair" can cover any differential pair and is not limited to pair 3 (e.g., contacts 1 and 2) of a conventional 8-pin pairing; and the phrase "fourth pair" can cover any differential pair and is not limited to pair 4 (e.g., contacts 7 and 8) of a conventional 8-pin pairing.

Figure 17:
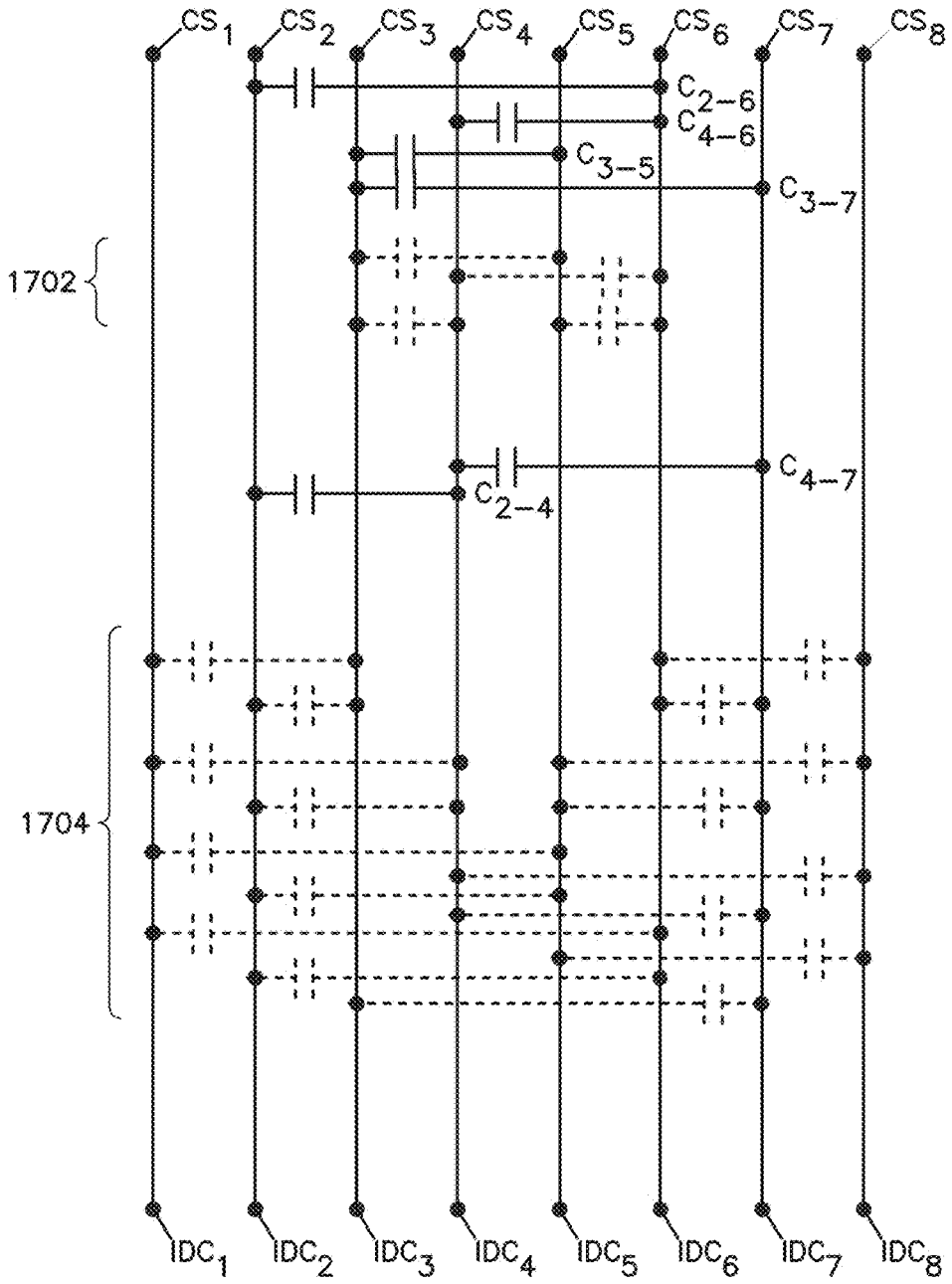
FIG. 17 schematically shows discrete capacitive couplings of FIG. 15 alongside induced capacitances between conductive pathways in a telecommunications jack.

FIG. 17 schematically shows discrete capacitive couplings of FIG. 15 alongside induced capacitances between conductive pathways in a telecommunications jack. In particular, FIG. 17 illustrates generally the discrete capacitive couplings applied in FIG. 15 to provide crosstalk compensation within a telecommunications connector. However, it is noted that, even with such crosstalk compensation applied, there may be alien crosstalk generated by the telecommunications jack that would have harmful effects on performance of a neighboring telecommunications jack. Accordingly, in some applications, and in particular where circuit density (and jack density) is high, it may be advisable to address alien crosstalk, even where addressing alien crosstalk has some minor detrimental effect on near end or far end crosstalk compensation within the jack (assuming that such adjustments can still be made within the performance parameters of the jack). Since it is difficult to predict, at the time of design, the alien crosstalk experienced by one jack based on a lack of knowledge regarding the environment in which that jack will be used, it is advisable to minimize the alien crosstalk generated by each jack to ensure that any alien crosstalk effects on neighboring jacks are accordingly minimized.

In the context of FIG. 17, it is noted that, in general, it has been observed that minimizing alien crosstalk generated by a telecommunications jack can be accomplished by balancing an overall magnitude of capacitive effects that are applied to each wire or track of a differential pair. For example, in a particular telecommunications jack, to address crosstalk compensation, one or more capacitances may be applied between differential pairs. Additionally, the tracks themselves can, if sufficiently close to one another, have capacitive coupling effects on each other. As illustrated in FIG. 17, the applied capacitances of FIG. 15 are shown, as well as additional coupling effects 1702, 1704. As shown in FIG. 17, a traditional 8-wire jack would experience a coupling effect 1702 corresponds to a capacitive coupling that occurs between tracks of the middle pairs (e.g., the pair formed by contacts 3 and 6, and the pair formed by contacts 4 and 5, respectively) of the connector. Additionally, a second coupling effect 1704 corresponds to the effects of the middle pairs on the outer pairs (contacts 1-2 and contacts 7-8, respectively). Although not specifically depicted in FIG. 17 due to the lesser effect, there may also be some coupling effect between the 1-2 and 7-8 tracks, depending upon the selected routing of tracks associated to those differential pairs.

When selecting crosstalk compensation to apply to a telecommunications jack, a design may first be optimized to address near end and far end crosstalk within the jack itself. Once capacitive crosstalk compensation is selected and applied to meet design specifications for the jack, the relative magnitudes of capacitance at each wire of one or more (preferably all) of the differential pairs are examined. To the extent possible while maintaining adequate near end and far end crosstalk performance, capacitance between tracks of differential pairs are adjusted to approximately balance the magnitudes of the overall capacitive effects, including the applied crosstalk compensation (e.g., as in FIG. 15), and the additional coupling effects 1702, 1704.

In some embodiments, the overall magnitude of the capacitance applied to each of the tracks of a particular pair may be made approximately equal, in that the magnitudes may be within 10% of each other. In some embodiments, the overall capacitance magnitudes may be within 5%, or even 2% of each other, in cases where alien crosstalk is of particular concern. Furthermore, although it is noted that capacitances should be approximately equal across a pair, capacitance magnitudes will typically vary among the different pairs included within a jack, with the capacitance magnitudes on the middle pairs generally higher than on the outer pairs.

It is noted that, although the overall compensation scheme discussed in connection with FIG. 17 is in the context of alien crosstalk generated at a jack, and balancing overall capacitive effects of circuit tracks within a jack, it is understood that balancing of capacitive effects for purposes of alien crosstalk minimization can be performed on a combination of a plug and jack, rather than simply for the jack, or alternatively for the plug itself. It is also noted that, for purposes of minimizing alien crosstalk generated at the telecommunications jack, the placement of capacitive couplings is not limited to the specific locations depicted herein. It is recognized that a variety of crosstalk compensation schemes can be selected that provide different balancings of crosstalk compensation across different ones of the differential pairs within the telecommunications jack, and additionally that different time delays or different magnitudes of capacitive crosstalk compensation may be applied to both conductors and/or tracks of a pair.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A telecommunications connector comprising:

a plurality of electrical conductors arranged in differential pairs;

a circuit board having a plurality of conductive layers, the plurality of conductive layers including a first conductive layer, a second conductive layer and a third conductive layer, the second conductive layer being positioned between the first and third conductive layers, the circuit board including a cross-talk compensation arrangement for applying capacitance between at least some of the electrical conductors, the cross-talk compensation arrangement including a plurality of open-ended conductive paths that provide a first capacitive coupling at a first discrete capacitive coupling location at the first conductive layer and a second capacitive coupling at a second discrete capacitive coupling location at the third conductive layer, the second conductive layer including a conductive plate positioned between the first and second discrete capacitive coupling locations, the conductive plate including a first surface that faces toward the first discrete capacitive coupling location and an opposite second surface that faces toward the second discrete capacitive coupling location, wherein the conductive plate and the first and second discrete capacitive coupling locations are relatively positioned such that: a) the first surface is adapted to reflect radiant energy from the first discrete capacitive coupling location back towards the first discrete capacitive coupling location to intensify the first capacitive coupling; and b) the second surface is adapted to reflect radiant energy from the second discrete capacitive coupling location back towards the second discrete capacitive coupling location to intensify the second capacitive coupling.

2. The telecommunications connector of claim 1, wherein the conductive plate forms an electromagnetic shield between the first and second discrete capacitive coupling locations.

3. The telecommunications connector of claim 1, wherein the conductive plate is a non-ohmic plate.

4. The telecommunications connector of claim 1, wherein the conductive plate is an ohmic plate.

5. The telecommunications connector of claim 4, wherein the conductive plate is electrically connected to a first open-ended conductive path of the plurality of open-ended conductive paths, and wherein the first open-ended conductive path is also electrically connected to capacitive elements provided at the first and second discrete capacitive coupling locations.

6. The telecommunications connector of claim 5, wherein the capacitive elements include capacitor fingers.

7. The telecommunications connector of claim 1, wherein the first and second discrete capacitive coupling locations include parallel capacitor fingers.

8. The telecommunications connector of claim 1, wherein the conductive plate is a localized plate that coincides with less that 25 percent of a total area defined by an outline of the circuit board.

9. A telecommunications connector comprising:

a plurality of electrical conductors arranged in differential pairs;

a circuit board having a plurality of conductive layers, the plurality of conductive layers including a first conductive layer, a second conductive layer and a third conductive layer, the circuit board including a cross-talk compensation arrangement for applying capacitance between at least some of the electrical conductors, the cross-talk compensation arrangement including a plurality of open-ended conductive paths including conductive pads provided at the first conductive layer, the open-ended conductive paths also including conductive vias that extend between the first, second and third conductive layers and that intersect the conductive pads, the open-ended conductive paths providing a first capacitive coupling at a first discrete capacitive coupling location at the third conductive layer, the second conductive layer including a non-ohmic conductive plate having a first side that faces toward the first discrete capacitive coupling location, the first side and the first discrete capacitive coupling location being relatively positioned such that the first side is adapted to reflect radiant energy from the first discrete capacitive coupling location back towards the first discrete capacitive coupling location to intensify the first capacitive coupling, wherein overlap is provided between the conductive plate and at least some of the conductive pads, and wherein at least one of the conductive vias passes through the conductive plate without electrically connecting to the conductive plate.

10. The telecommunications connector of claim 9, wherein the first discrete capacitive coupling location includes capacitor fingers, wherein overlap is provided between the capacitive fingers and at least some of the conductive pads.

11. The telecommunications connector of claim 9, wherein the first discrete capacitive coupling location includes capacitor fingers, and wherein the conductive via that passes through the conductive plate intersects one of the capacitor fingers at an intermediate location along a length of the capacitor finger.

12. The telecommunications connector of claim 9, wherein the electrical connector is a jack, wherein the electrical conductors include contact springs having free ends and fixed ends, and wherein the free ends of the contact springs contact the conductive pads.

13. A telecommunications jack comprising:

a front housing defining a plug port;

a circuit board positioned within the front housing;

first, second, third, fourth, fifth, sixth, seventh and eighth consecutively arranged electrical contact springs arranged in differential pairs;

the circuit board having a plurality of conductive layers, the plurality of conductive layers including a first conductive layer, a second conductive layer and a third conductive layer, the second conductive layer being positioned between the first and third conductive layers, the circuit board including a cross-talk compensation arrangement for applying capacitance between at least some of the electrical contact springs, the cross-talk compensation arrangement including a plurality of open-ended conductive paths that provide a first capacitive coupling at a first discrete capacitive coupling location at the first conductive layer and a second capacitive coupling at a second discrete capacitive coupling location at the third conductive layer, the first capacitive coupling being applied between the third and fifth electrical contact springs and the second capacitive coupling being applied between the third and seventh electrical contact springs, the second conductive layer including a conductive plate positioned between the first and second discrete capacitive coupling locations, the conductive plate being an ohmic plate that is electrically connected to the third electrical contact spring, the conductive plate including a first surface that faces toward the first discrete capacitive coupling location and an opposite second surface that faces toward the second discrete capacitive coupling location, wherein the conductive plate and the first and second discrete capacitive coupling locations are relatively positioned such that: a) the first surface is adapted to reflect radiant energy from the first discrete capacitive coupling location back towards the first discrete capacitive coupling location to intensify the first capacitive coupling; and b) the second surface is adapted to reflect radiant energy from the second discrete capacitive coupling location back towards the second discrete capacitive coupling location to intensify the second capacitive coupling.

14. The telecommunications jack of claim 13, wherein the first, second, third, fourth, fifth, sixth, seventh and eighth electrical contact springs have fixed ends and free ends, and wherein the free ends engage electrically conductive pads on the first layer of the circuit board.

15. The telecommunications jack of claim 14, wherein the open-ended conductive paths also include conductive vias that extend between the first, second and third conductive layers and that intersect the conductive pads, the open-ended conductive paths providing a third capacitive coupling at a third discrete capacitive coupling location at the third conductive layer, the second conductive layer including a non-ohmic conductive plate having a first side that faces toward the third discrete capacitive coupling location, the first side and the third discrete capacitive coupling location being relatively positioned such that the first side is adapted to reflect radiant energy from the third discrete capacitive coupling location back towards the third discrete capacitive coupling location to intensify the third capacitive coupling, wherein overlap is provided between the non-ohmic conductive plate and at least some of the conductive pads, wherein at least one of the conductive vias passes through the non-ohmic conductive plate without electrically connecting to the non-ohmic conductive plate, and wherein the third capacitive coupling is applied between the fourth and sixth electrical spring contacts.

16. The telecommunications jack of claim 15, wherein the first, second and third discrete capacitive coupling locations each include capacitor fingers.

17. A telecommunications connector for use in a twisted pair system, the connector comprising:

a plurality of electrical conductors arranged in differential pairs;

a circuit board including conductive tracks that electrically connect to the plurality of electrical conductors;

a first crosstalk compensation arrangement disposed on the circuit board and including a first plurality of near end and far end crosstalk compensating capacitances applied between electrical conductors associated with at least first and second differential pairs, the first crosstalk compensation arrangement configured to address near end and far end crosstalk within the telecommunications connector; and a second crosstalk compensation arrangement disposed on the circuit board including a second plurality of alien crosstalk compensating capacitances applied between electrical conductors and selected such that, for each differential pair, a magnitude of an overall capacitance at a first electrical conductor of the first differential pair is approximately equal to a magnitude of an overall capacitance at a second electrical conductor of the first differential pair, the second crosstalk compensation arrangement configured to address alien crosstalk between the telecommunications connector and an associated telecommunications connector, wherein the magnitudes of the overall capacitance at the first and second conductors includes the first plurality of near end and far end crosstalk compensating capacitances and capacitive coupling effects resulting from capacitive coupling occurring between the conductors of the first and second differential pairs.

18. The telecommunications connector of claim 17, wherein the overall capacitance at each of the first and second electrical conductors includes capacitive effects of electrical conductors of the second differential pair on each of the first and second electrical conductors of the differential pair.

19. The telecommunications connector of claim 18, wherein the overall capacitance at each of the first and second electrical conductors further includes one or more of the plurality of crosstalk compensating capacitances.

20. The telecommunications connector of claim 17, wherein the telecommunications connector comprises a telecommunications jack.

21. The telecommunications connector of claim 17, wherein, by maintaining approximately equal magnitude capacitances on the first and second electrical conductors of each differential pair, an overall alien crosstalk generated by the telecommunications connector is minimized.

22. The telecommunications connector of claim 17, wherein the crosstalk compensating capacitances include capacitor fingers.

23. The telecommunications connector of claim 17, wherein the magnitude of overall capacitance at the first electrical conductor is within about 10% of the magnitude of overall capacitance at the second electrical conductor.

24. A method for managing alien crosstalk at a first jack from a second jack, the method comprising:

determining a plurality of near end and far end crosstalk compensating capacitances for application between electrical conductors associated with at least first and second differential pairs of the second jack to compensate for near end and far end crosstalk within the second jack;

determining overall capacitive effects resulting to each of the conductors of the associated first and second differential pairs of the second jack, including the plurality of effects resulting from capacitive coupling occurring between the conductors of the first and second differential pairs of the second jack;

adjusting the determined near end and far end crosstalk compensating capacitances to minimize a difference in the overall capacitive effects resulting the electrical conductors associated with the first differential pair of the second jack; and adjusting the determined near end and far end crosstalk compensating capacitances to minimize a difference in the overall capacitive effects resulting to the electrical conductors associated with the second differential pair of the second jack.

25. The method of claim 24, wherein minimizing a difference in overall capacitance applied within the second jack to first and second electrical conductors of the same differential pair includes varying one or more discrete capacitances applied at one or both of the first and second electrical conductors.

26. The method of claim 25, wherein the one or more discrete capacitances comprise crosstalk compensation capacitances.

27. A telecommunications connector for use in a twisted pair system, the jack comprising:

a plurality of electrical conductors arranged in differential pairs;

a circuit board including conductive tracks that electrically connect to the plurality of electrical conductors;

a crosstalk compensation arrangement disposed on the circuit board and including a first plurality of near end and far end crosstalk compensating capacitances applied between electrical conductors associated with first and second differential pairs, the first crosstalk compensation arrangement configured to address near end and far end crosstalk within the telecommunications connector; and a second plurality of alien crosstalk compensating capacitances applied between electrical conductors and selected such that, for each differential pair, a difference in magnitudes of an overall capacitance at a first electrical conductor of the first differential pair and an overall capacitance at a second electrical conductor of the first differential pair is minimized, the second crosstalk compensation arrangement configured to address alien crosstalk between the telecommunications connector and an associated telecommunications connector;

wherein the magnitudes of the overall capacitance at the first and second conductors includes the first plurality of near end and far end crosstalk compensating capacitances and capacitive coupling effects resulting from capacitive coupling occurring between the conductors of the first and second differential pairs.

28. The telecommunications connector of claim 27, wherein, by minimizing a difference in magnitudes of overall capacitance at first and second electrical conductors of each differential pair, an overall alien crosstalk generated by the telecommunications connector is minimized.

29. The telecommunications connector of claim 27, wherein the overall capacitance at each of the first and second electrical conductors includes capacitive effects of electrical conductors of the second differential pair on each of the first and second electrical conductors of the differential pair.

30. The telecommunications connector of claim 29, wherein the overall capacitance at each of the first and second electrical conductors further includes one or more of the plurality of crosstalk compensating capacitances.

31. The telecommunications connector of claim 27, wherein the telecommunications connector comprises a telecommunications jack.

* * * * *